US012623759B2

(12) United States Patent
Shiue

(10) Patent No.: US 12,623,759 B2
(45) Date of Patent: May 12, 2026

(54) BREATHABLE MASK

(71) Applicant: QBAS Co., Ltd., Taipei City (TW)

(72) Inventor: Chih-Cheng Shiue, Taipei City (TW)

(73) Assignee: QBAS CO., LTD., Taipei City (TW)

( * ) Notice: Subject to any disclaimer, the term of this patent is extended or adjusted under 35 U.S.C. 154(b) by 656 days.

(21) Appl. No.: 18/101,337

(22) Filed: Jan. 25, 2023

(65) Prior Publication Data

US 2023/0242226 A1 Aug. 3, 2023

Related U.S. Application Data

(60) Provisional application No. 63/356,237, filed on Jun. 28, 2022, provisional application No. 63/304,383, filed on Jan. 28, 2022.

(51) Int. Cl.
*B63C 11/16* (2006.01)

(52) U.S. Cl.
CPC ..... *B63C 11/16* (2013.01)

(58) Field of Classification Search
CPC ..... B63C 11/16; B63C 11/18; B63C 11/20; B63C 11/205; B63C 11/207; B63C 11/12; B63C 11/02; B63C 2011/165
See application file for complete search history.

(56) References Cited

U.S. PATENT DOCUMENTS 3,166,083 A * 1/1965 Girden ..... B63C 11/16 137/400
3,653,086 A * 4/1972 Gongwer ..... B63C 11/16 D24/110.2
5,485,832 A * 1/1996 Joffity ..... B63C 11/205 128/206.29
6,668,823 B1 12/2003 Liu
2006/0037607 A1* 2/2006 Trujillo ..... B63C 11/16 128/201.27
2013/0074835 A1* 3/2013 Newhouse ..... B63C 11/16 128/201.11
2017/0334531 A1 11/2017 Shine
(Continued)

FOREIGN PATENT DOCUMENTS

CN 2246118 Y 1/1997
CN 108688781 A 10/2018
(Continued)

*Primary Examiner* — Colin W Stuart
(74) *Attorney, Agent, or Firm* — MUNCY, GEISSLER, OLDS & LOWE, P.C.

(57) ABSTRACT

A breathable mask includes a body having a main frame, a lens, and a waterproof sealing skirt. The waterproof sealing skirt has a partition dividing the interior of the body into an upper chamber that shields the eyes and a lower chamber that shields the nose, and arranges independent air intake passages and exhaust passages to separate the fresh air inhaled and the dirty air exhaled. Alternatively, a nasal connecting portion having a purge valve can be provided in fluid communication with the lower chamber. It is also possible to provide a three-way connector having a nasal connecting portion, a mouth portion, and a drain portion in fluid communication with one another, wherein the nasal connecting portion is in fluid communication with the lower chamber. The mouth connecting portion is adapted to be contained in the user's mouth when the user well wears the breathable mask.

30 Claims, 20 Drawing Sheets

(56) References Cited

U.S. PATENT DOCUMENTS

| | | | | |
|---|---|---|---|---|
| 2019/0225312 | A1* | 7/2019 | Barone | B63C 11/205 |
| 2020/0130792 | A1* | 4/2020 | Huang | B63C 11/16 |
| 2020/0307749 | A1* | 10/2020 | Xiao | A61M 16/06 |
| 2021/0284300 | A1* | 9/2021 | Barone | B63C 11/16 |

FOREIGN PATENT DOCUMENTS

| | | | |
|---|---|---|---|
| CN | 208979080 | U | 6/2019 |
| CN | 110104142 | A | 8/2019 |
| DE | 202014011182 | U1 | 5/2018 |
| DE | 202019106349 | U1 | 4/2020 |
| EP | 3153400 | A1 | 4/2017 |
| EP | 3647179 | A1 | 5/2020 |
| JP | 2012045369 | A | 3/2012 |
| WO | WO2013/167769 | A1 | 11/2013 |

* cited by examiner

BREATHABLE MASK

CROSS-REFERENCES TO RELATED APPLICATIONS

This patent application claims the benefits of U.S. Prov. Ser. No. 63/304,383 filed on Jan. 28, 2022, and No. 63/356,237 filed on Jun. 28, 2022. All of the above applications are incorporated by reference herein.

BACKGROUND OF THE INVENTION

Field of the Invention

The present invention relates to a mask for water sports, in particular, to a breathable mask that a snorkeler can breathe by his/her nose, or by his/her nose and mouth when wearing the mask.

Descriptions of the Related Art

As shown in FIG. 1, most of the current snorkeling activities use a mask 1 that covers the eyes and nose, and a snorkel 2. The user can't use the nose to breathe at all, and can only use the mouth to breathe through the snorkel 2. Because the breathing tube 2 extends from one side of the mask 1, it is unbalanced in use. In addition, because the breathing tube 2 needs to be connected to the mask 1, the connection position is usually very close to the head strap 3 of the mask 1, and the head strap 3 is easy to get entangled with hair, such snorkeling equipment increases the trouble for users to wear. In addition, human beings are used to breathe through their noses in the air, so using this equipment will force the user to breathe through the mouth only, which is against the human's physical nature.

Based on the above-mentioned shortcoming, the industry has begun to consider adopting the top snorkel 4 of the full-face snorkel mask (FFSM) to fit onto the traditional diving mask 5, and then let it communicate with the interior of the mask 5, allowing the user to breathe through the nose. That is to say, the traditional mouthpiece-type breathing tube 2 as shown in FIG. 1 is replaced with the design as shown in FIG. 2A. Of course, this design is smaller than an FFSM, and it can maintain a good fit with the user's face. However, the breathing tube 4 in this design communicates with the nose pocket 7 of the mask 5 through a tunnel 6 on order to let the user be able to breathe through the nose (also see FIG. 2B). With this design, the airflow of inhalation and exhalation is not separated. During the breathing cycles, clean air and dirty air will be rapidly mixed in the nose pocket 7 of the mask 5, and the concentration of carbon dioxide in the mask 5 will rise sharply, making it easy for the user to be unconsciously hypoxic in a short period of time. When the user feels uncomfortable, there is no way to switch to mouth breathing. In addition, due to the improper use of the shape and material of the nasal covering portion 8 of this design, after the actual use test, due to the water pressure P, the result of "automatic nose pinching" will occur (as shown in FIG. 2C), hindering nose breathing. The chance of danger becomes higher. Again, the water leaking in the mask 5 will be accumulated in the nose pocket 7 inside the nose covering portion 8, which is very close to the user's nostrils. This accumulated water makes the user feel uncomfortable and even choke on water.

Moreover, the face mask 5 can only cover eyes and nose, and the user's mouth is still exposed to water. This causes the user to naturally close the mouth to prevent accidental drinking of water, which has no sense of safety.

Therefore, proposing a design that partially or fully solves the above-mentioned problems will be a great breakthrough, and become the goal pursued by the industry.

SUMMARY OF THE INVENTION

The first objective of the present invention is to provide a breathable mask that covers the user's eyes and nose, allowing the user's nose to breathe freely in the mask, and allowing the fresh air inhaled and the dirty air exhaled to be separated. The shunt airflow does not let the carbon dioxide concentration in the mask increase. To achieve this objective, the present invention provides a breathable mask comprising a body and a breathing tube, the breathing tube being in fluid communication with an interior of the body; the breathing tube including an intake conduit and an exhaust conduit adjacent to the intake conduit. The body includes a main frame, a lens fitted in the main frame, and a waterproof sealing skirt, partially fitted with the main frame and the lens. The waterproof sealing skirt is suitable for fitting on a user's face, wherein the waterproof sealing skirt has a partition, which divides the interior of the body into an upper chamber and the lower chamber, whereby when a user wears the breathable mask through a fastening device, the partition is seated on the user's nose, and the user's eyes are accommodated in the upper chamber, whereas the user's nose is accommodated in the lower chamber. The mask is characterized in that the body further includes an intake passage and an exhaust passage. The intake passage is formed between the intake conduit and the lower chamber. The intake passage is provided with a first one-way valve, wherein the first one-way valve is disposed on the partition, and the first one-way valve is provided for external fresh air to enter the lower chamber through the intake passage. The exhaust passage is formed between the exhaust conduit and the lower chamber, and the exhaust passage is provided for dirty air exhaled by the user to pass through and be discharged outside. The intake passage and the exhaust passage are in fluid independent of each other.

The second objective of the present invention is to provide a breathable mask that covers the user's eyes and nose, allowing the user's nose to breathe freely in the mask, and allowing the fresh air inhaled and the dirty air exhaled to be separated. The shunt airflow does not let the carbon dioxide concentration in the mask increase. In addition, there is a nasal connecting portion extending outwards from the bottom of the mask, and a purge valve is provided to store water leaking in the mask so that the water stays away from the nostrils and can be effectively discharged through the purge valve. To achieve the above object, the present invention mainly provides a breathable mask comprising a body and a breathing tube, the breathing tube being in fluid communication with an interior of the body; the breathing tube including an intake conduit and an exhaust conduit adjacent to the intake conduit. The body includes a main frame, a lens fitted in the main frame, and a waterproof sealing skirt, partially fitted with the main frame and the lens. The waterproof sealing skirt is suitable for fitting on a user's face, wherein the waterproof sealing skirt has a partition, which divides the interior of the body into an upper chamber and the lower chamber, whereby when a user wears the breathable mask through a fastening device, the partition is seated on the user's nose, and the user's eyes are accommodated in the upper chamber, whereas the user's nose is accommodated in the lower chamber. The mask is characterized in that the body further includes an intake passage, an exhaust passage, and a nasal connecting portion. The intake passage is formed between the intake conduit and the lower chamber, and is provided with a first one-way valve, wherein the first one-way valve is provided for external fresh air to enter the lower chamber through the intake passage. The exhaust passage is formed between the exhaust conduit and the lower chamber, and the exhaust passage is provided for dirty air exhaled by the user to pass through and be discharged outside. The nasal connecting portion has one end being in fluid communication with the lower chamber, and the other end being provided with a purge valve.

The third objective of the present invention is to provide a breathable mask that covers the user's eyes and nose, allowing the user's nose to breathe freely in the mask, and allowing the fresh air inhaled and the dirty air exhaled to be separated. The shunt airflow does not let the carbon dioxide concentration in the mask increase. In addition, there is a three-way connector extending outward from the bottom of the mask. One way of the three-way connectors is connected to the nasal covering portion, and another way thereof is provided with a purge valve to store water leaking in the mask to keep the water to stay away from the nostrils, and effectively let the water pass through the purge valve. The other way of three-way connectors is coupled with a mouthpiece to allow the user's mouth to contain. In addition to improving the stability of wearing the mask, it also allows the user to breathe by the mouth, in addition to using the nose to inhale and exhale. To achieve this objective, the present invention provides a breathable mask comprising a body and a breathing tube, the breathing tube being in fluid communication with an interior of the body; the breathing tube including an intake conduit and an exhaust conduit adjacent to the intake conduit. The body includes a main frame, a lens fitted in the main frame, and a waterproof sealing skirt, partially fitted with the main frame and the lens. The waterproof sealing skirt is suitable for fitting on a user's face; wherein the waterproof sealing skirt has a partition, which divides the interior of the body into an upper chamber and the lower chamber, whereby when a user wears the breathable mask through a fastening device, the partition is seated on the user's nose, and the user's eyes are accommodated in the upper chamber, whereas the user's nose is accommodated in the lower chamber. The mask is characterized in that the body further includes an intake passage, an exhaust passage, and a three-way connector. The intake passage is formed between the intake conduit and the lower chamber, and is provided with a first one-way valve, wherein the first one-way valve is provided for external fresh air to enter the lower chamber through the intake passage. The exhaust passage is formed between the exhaust conduit and the lower chamber, and the exhaust passage is provided for dirty air exhaled by the user to pass through and to be discharged outside. The three-way connector has a nasal connecting portion, a mouth portion, and a drain portion which are in fluid communication with one another, wherein the nasal connecting portion is in fluid communication with the lower chamber, whereby when the user puts on the breathable mask, the mouth portion is suitable for being contained in the user's mouth.

In order to achieve the above three objectives along with, the nasal covering portion of the present invention can use a material with a specific hardness or provide a design with a specific shape, thereby not being influenced by water pressure to hinder the normal breathing of the nose.

DESCRIPTION OF THE PREFERRED EMBODIMENT

Figure 1:
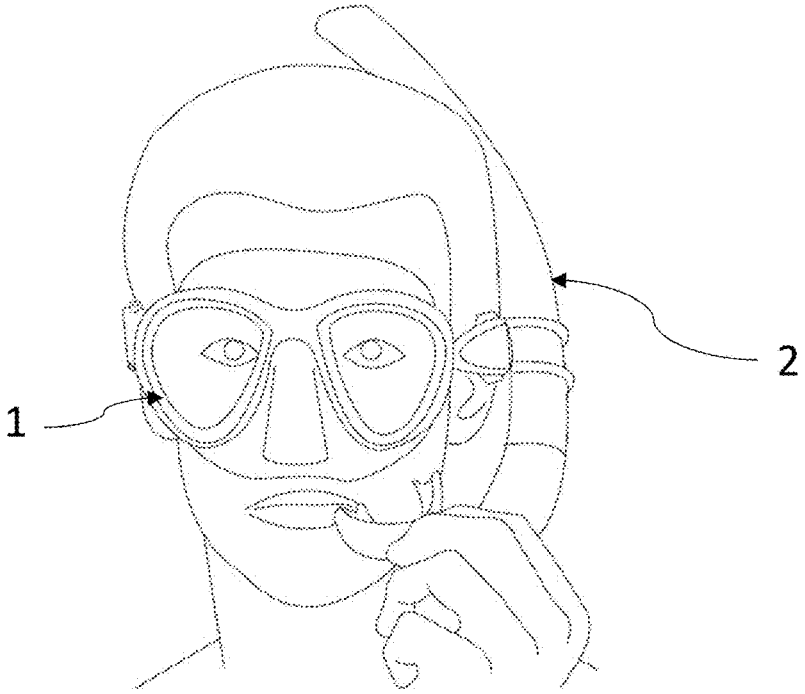
FIG. 1 (PRIOR ART)
FIG. 1 is a schematic diagram of a user wearing the snorkeling equipment of the prior art.

The first embodiment of the present invention mainly provides a breathable mask that covers the user's eyes and nose, allowing the user's nose to breathe freely in the mask, and allowing the inhaled fresh air and the exhaled dirty air to be separated.

As shown in FIGS. 3A to 3E, a breathable mask 10 includes a body 11 and a breathing tube 12, and the breathing tube 12 is in fluid communication with the interior of the body 11. The breathing tube 12 includes an intake conduit 121, and an exhaust conduit 122 adjacent to the intake conduit 121. Preferably, the breathing tube 12 is made of hard material. The exhaust conduit 122 has two branches, one of which is on the left side and the other of which is on the right side of the intake conduit 121. The body 11 includes a main frame 13, a lens 14 fitted in the main frame 13, and a waterproof sealing skirt 15 partially fitted with the main frame 13 and the lens 14. The waterproof sealing skirt 15 is adapted to fit the face of a user. The waterproof sealing skirt 15 has a partition 16, which divides the interior of the body 11 into an upper chamber 17 and a lower chamber 18. When the user wears the breathable mask 10 through tighten up a fastening device (i.e., an elastic head strap, not shown), the partition 16 is seated on the user's nose, and the user's eyes are accommodated in the upper chamber 17, whereas the user's nose is accommodated in the lower chamber 18. The breathable mask 10 is characterized in that the body 11 further includes an intake passage and an exhaust passage. The intake passage is formed between the air intake conduit 121 and the lower chamber 18, and is provided with a first one-way valve 161, wherein the first one-way valve 161 is disposed on this partition 16. The first one-way valve 161 is provided for external fresh air to enter the lower chamber 18 through the intake passage. The exhaust passage is formed between the exhaust conduit 122 and the lower chamber 18, and the exhaust passage is provided only for dirty air exhaled by the user to pass through and to be discharged outside. The intake passage and the exhaust passage are in fluid independent of each other.

Figure 3A:
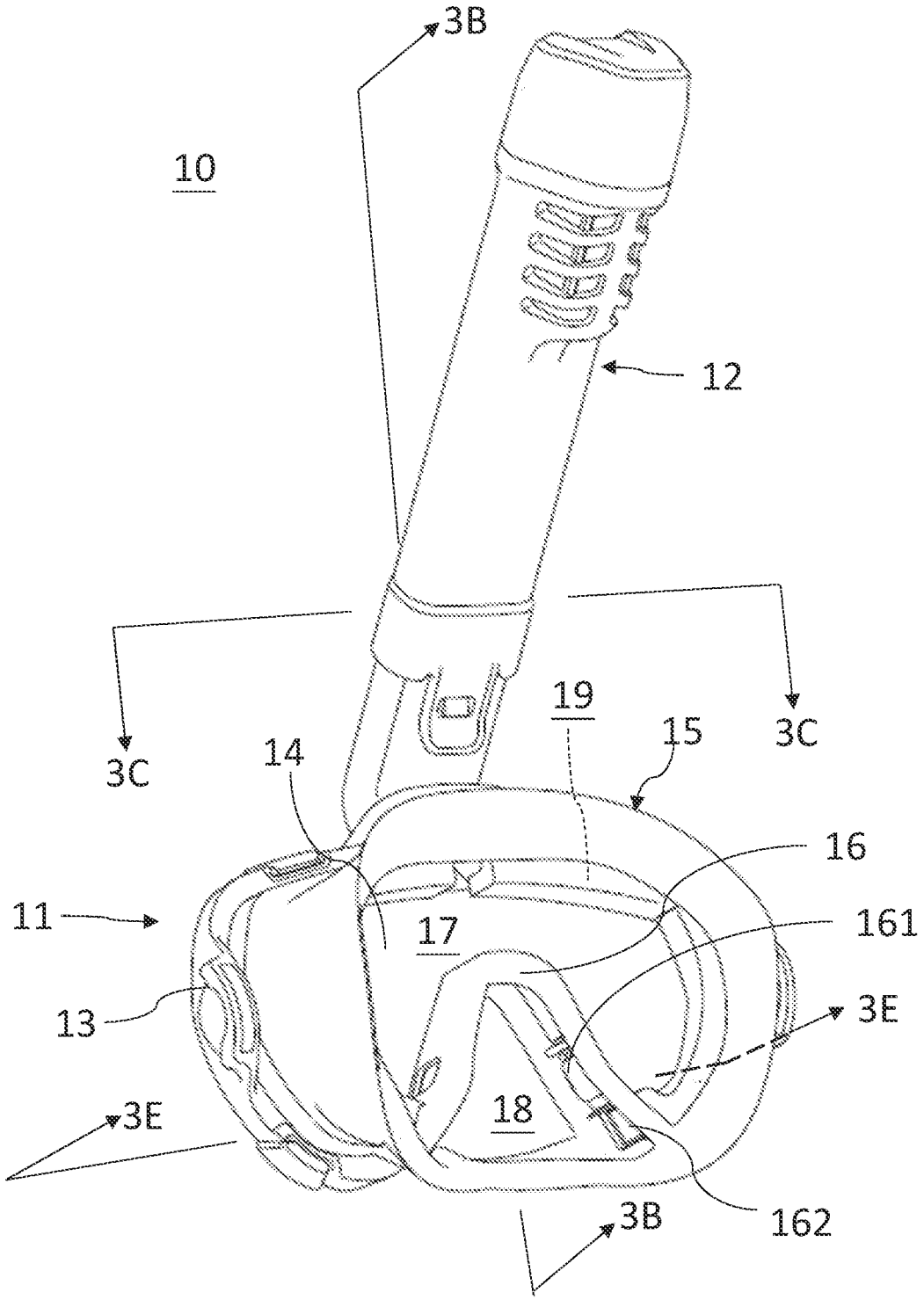
FIG. 3A is a rear perspective view of the first embodiment of the present invention.
Figure 3B:
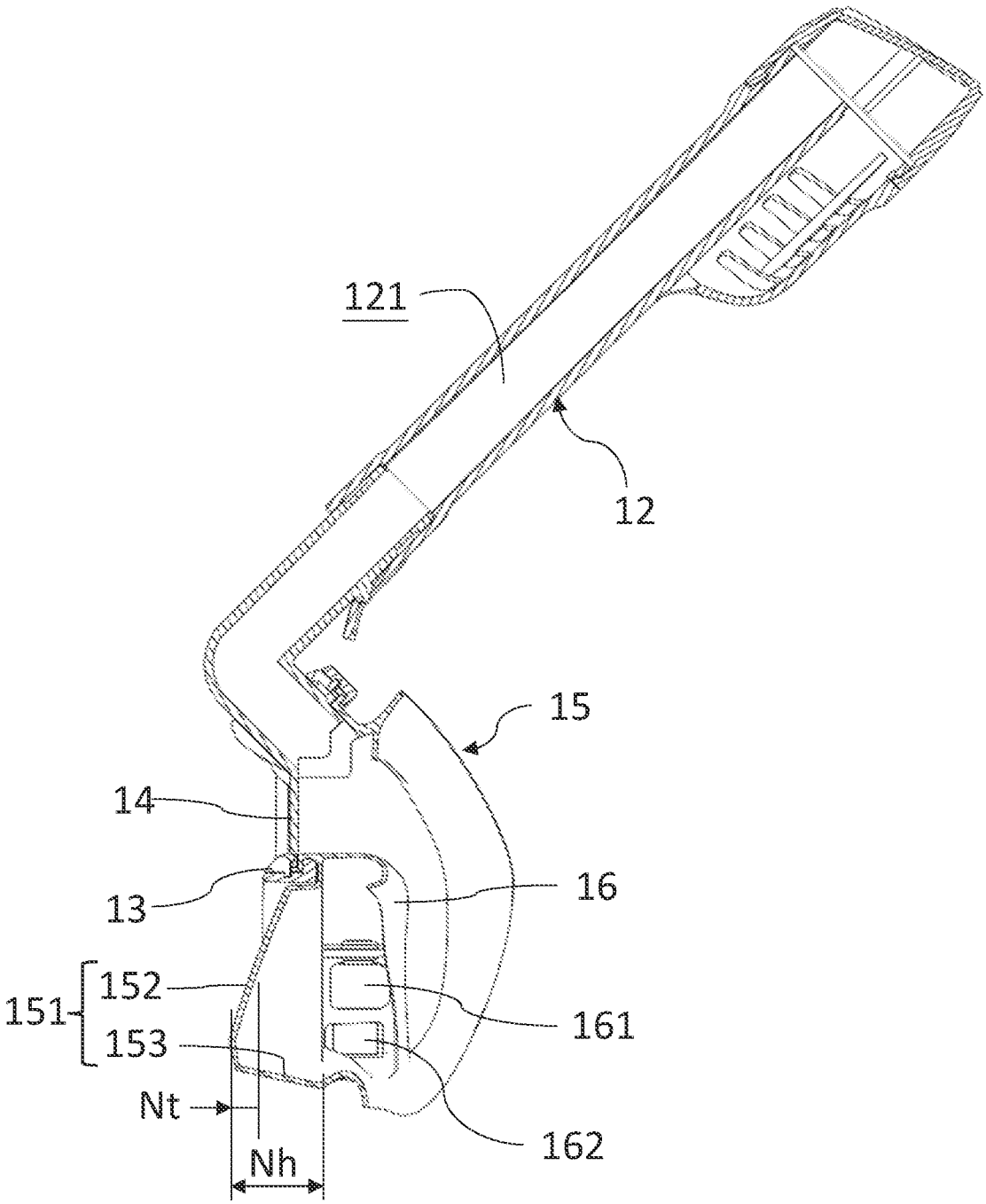
FIG. 3B is a sagittal cross-sectional view taken along line 3B-3B in FIG. 3A.
Figure 3C:
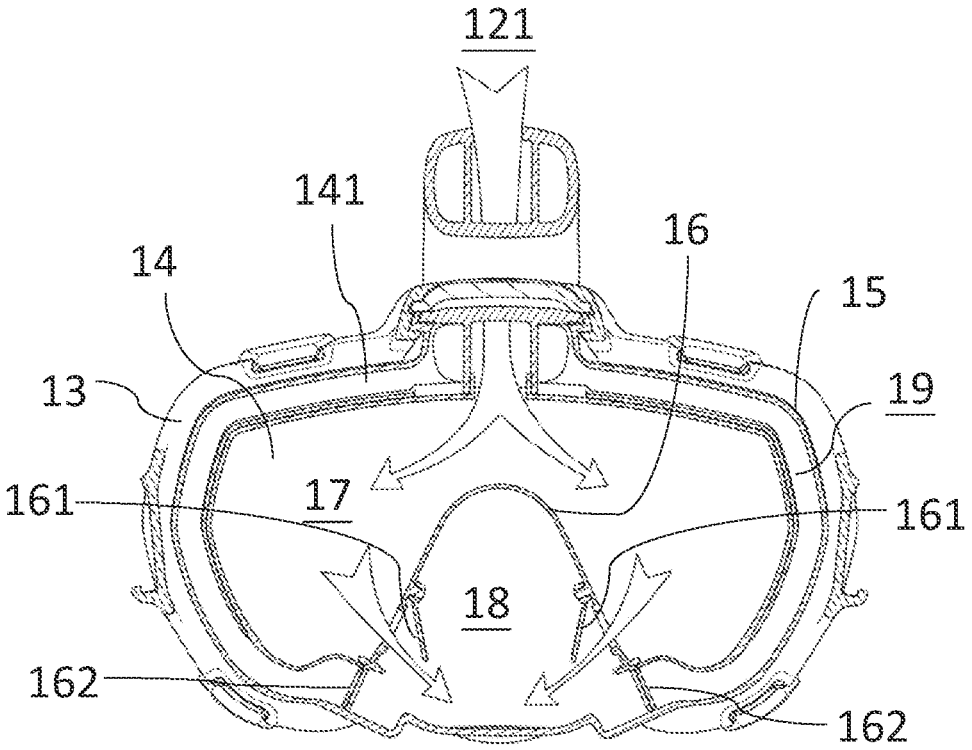
FIG. 3C is a coronal cross-sectional view taken along line 3C-3C in FIG. 3A, showing the intake airflow.
Figure 3D:
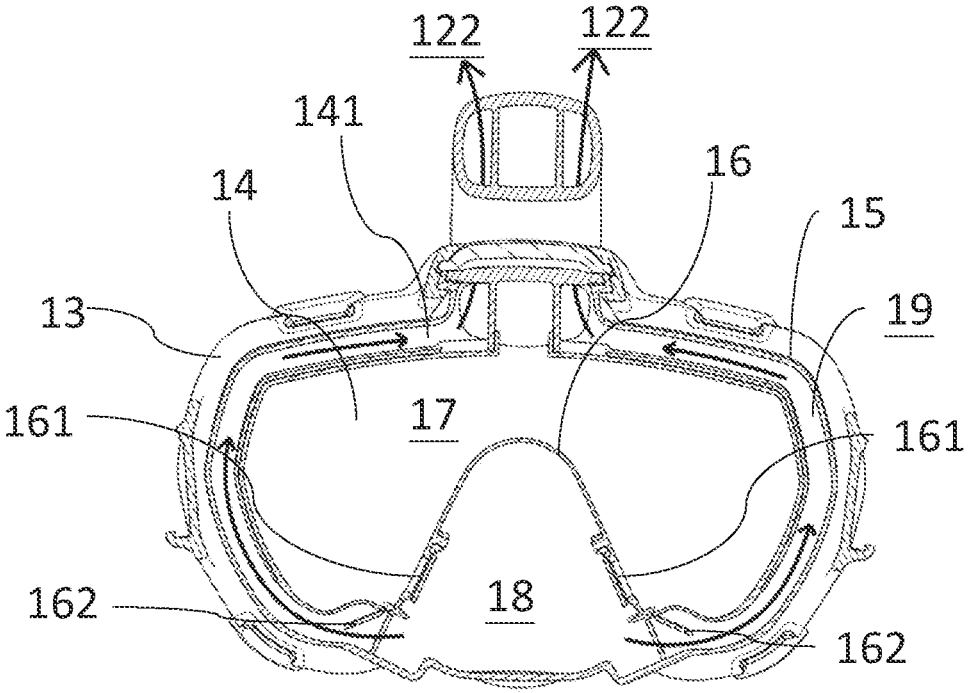
FIG. 3D is the same as FIG. 3C but showing the exhaust airflow.

In order to make the small amount of dirty air staying in the exhaust passage not flow back to the lower chamber 18 to mix again with the fresh air inhaled by the user in the next breathing cycle, causing a small amount of carbon dioxide to be accumulated in the mask, a second one-way valve 162 can be provided. This way, the intake passage is defined by the upper chamber 17 and the first one-way valve 161, whereas the exhaust passage is defined by the second one-way valve 162 and an exhaust tunnel 19. And the exhaust tunnel 19 is formed by the waterproof sealing skirt 15 together with a peripheral edge 141 of the lens 14, as shown in FIGS. 3A to 3C. Further in reference to FIG. 3C, the second one-way valve 162 is disposed on the partition 16. When the user inhales, fresh air passes from the intake conduit 121, through the upper chamber 17, and enters the lower chamber 17 through the first one-way valve 161 to supply the user's nose (N) to inhale; whereas when the user exhales, the dirty air passes through the second one-way valve 162 and the exhaust tunnel 19, and is then discharged outside through the exhaust conduit 122, as shown in FIG. 3D.

Figure 3E:
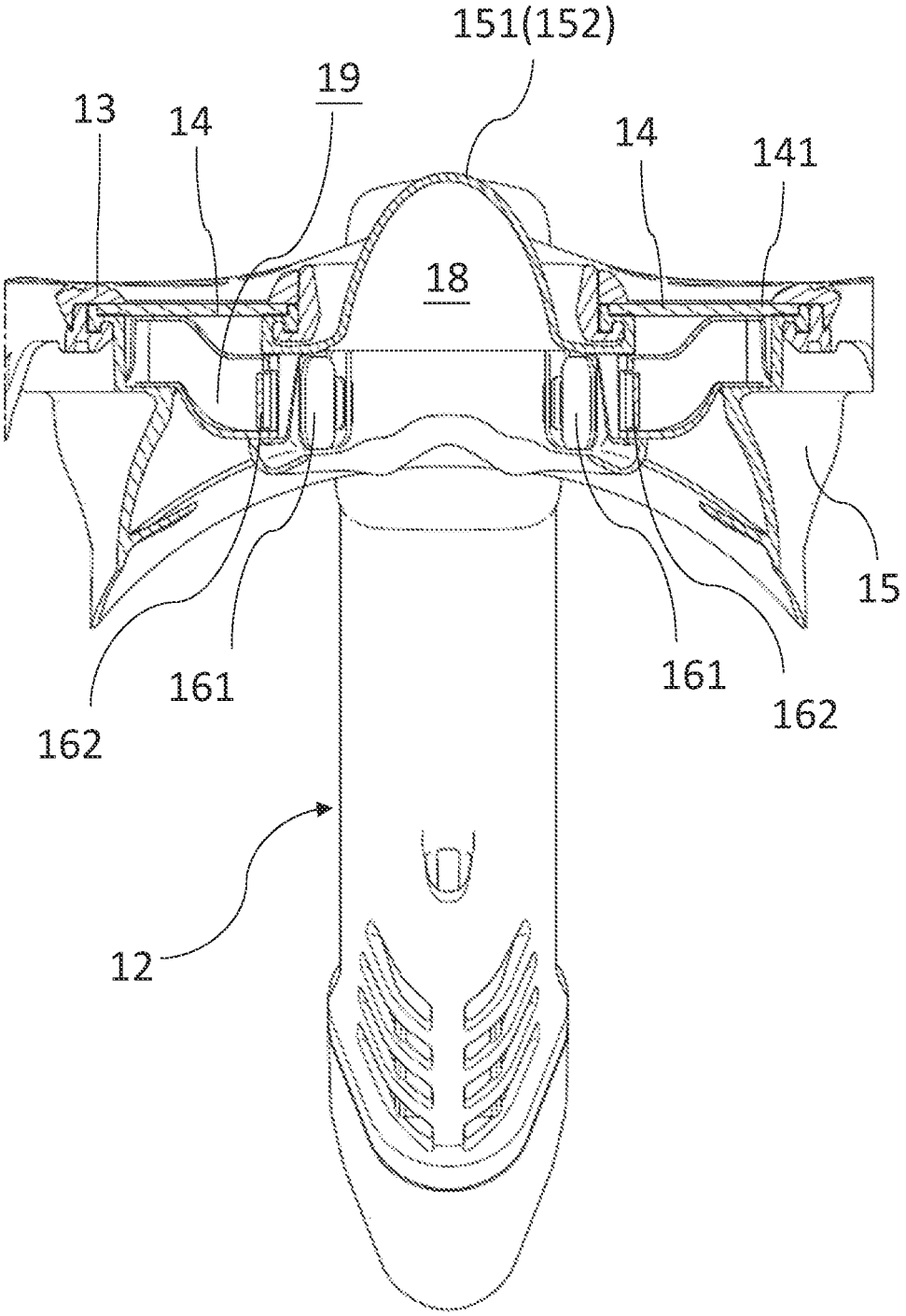
FIG. 3E is a cross-sectional view taken along line 3E-3E in FIG. 3A, showing the cross-sectional shape of the nasal covering portion.

The waterproof sealing skirt 15 further includes a nasal covering portion 151, which defines the lower chamber 18 together with the partition 16, wherein the nasal covering portion 151 has a protruding area 152 and a bottom area 153 corresponding to the user's nostrils, as shown in FIG. 3B. In order to prevent the nasal covering portion 151 from being deformed by water pressure, the nasal covering portion 151 is preferably made of a hard material, and has a Shore D hardness of 50-90, which is selected from polycarbonate (PC), Polypropylene (PP), polyethylene (PE), polyvinyl-chloride (PVC), acrylonitrile-butadiene-styrene copolymer (ABS) or combinations thereof. As shown in FIGS. 3B and 3E, the nasal covering portion 151 can also be made of a softer material, with a Shore A hardness of 30-95, which is formed in a specific shape. Specifically, the nasal covering portion 151 is made of a softer material with Shore A hardness of 30-95, and the protruding area 151 gently extends forward from a rear edge of the main frame 13 to form a cross section having a single-crest mountain shape, in which the cross section has a maximum height (Nh) ranging between 20 mm and 35 mm. Alternatively, the protruding area 152 protrudes forward from the rear edge of the main frame 13 to go beyond a lower, outer edge of the main frame 13 for a maximum extent (Nt) ranging between 5 mm and 20 mm.

The second embodiment of the present invention is mainly different from the first embodiment in that in the second embodiment, a nasal connecting portion is provided to be in fluid communication with the lower chamber of the mask, and a purge valve is provided on the nasal connecting portion. This can allow the accumulated water in the mask have space to store, and the water can be discharged through the purge valve. Furthermore, part of the dirty air exhaled from the nose can also be discharged through the purge valve, making the drainage and exhaust smoother. . . .

Specifically, as shown in FIGS. 4A to 4F, a breathable mask 20 comprises a body 21 and a breathing tube 22, the breathing tube 22 being in fluid communication with an interior of the body 21. The breathing tube includes an intake conduit 221 and an exhaust conduit 222 adjacent to the intake conduit 221. The body 21 includes a main frame 23, a lens 24 fitted in the main frame 23, and a waterproof sealing skirt 25 partially fitted with the main frame 23 and the lens 24. The waterproof sealing skirt 25 is suitable for fitting on a user's face, wherein the waterproof sealing skirt 25 has a partition 26, which divides the interior of the body 21 into an upper chamber 27 and the lower chamber 28, whereby when a user wears the breathable mask 20 through a fastening device (i.e., a head strap, not shown), the partition 26 is seated on the user's nose, and the user's eyes are accommodated in the upper chamber 27, whereas the user's nose is accommodated in the lower chamber 28. The mask 20 is characterized in that the body 21 further includes an intake passage, an exhaust passage, and a nasal connecting portion 280. The intake passage is formed between the intake conduit 221 and the lower chamber 28, and is provided with a first one-way valve 261, wherein the first one-way valve 261 is provided for external fresh air to enter the lower chamber 28 through the intake passage. The exhaust passage is formed between the exhaust conduit 222 and the lower chamber 28, and the exhaust passage is provided for dirty air exhaled by the user to pass through and to be discharged outside. The nasal connecting portion 280 has one end being in fluid communication with the lower chamber 28, and the other end being provided with a purge valve 284. . . .

Figure 4A:
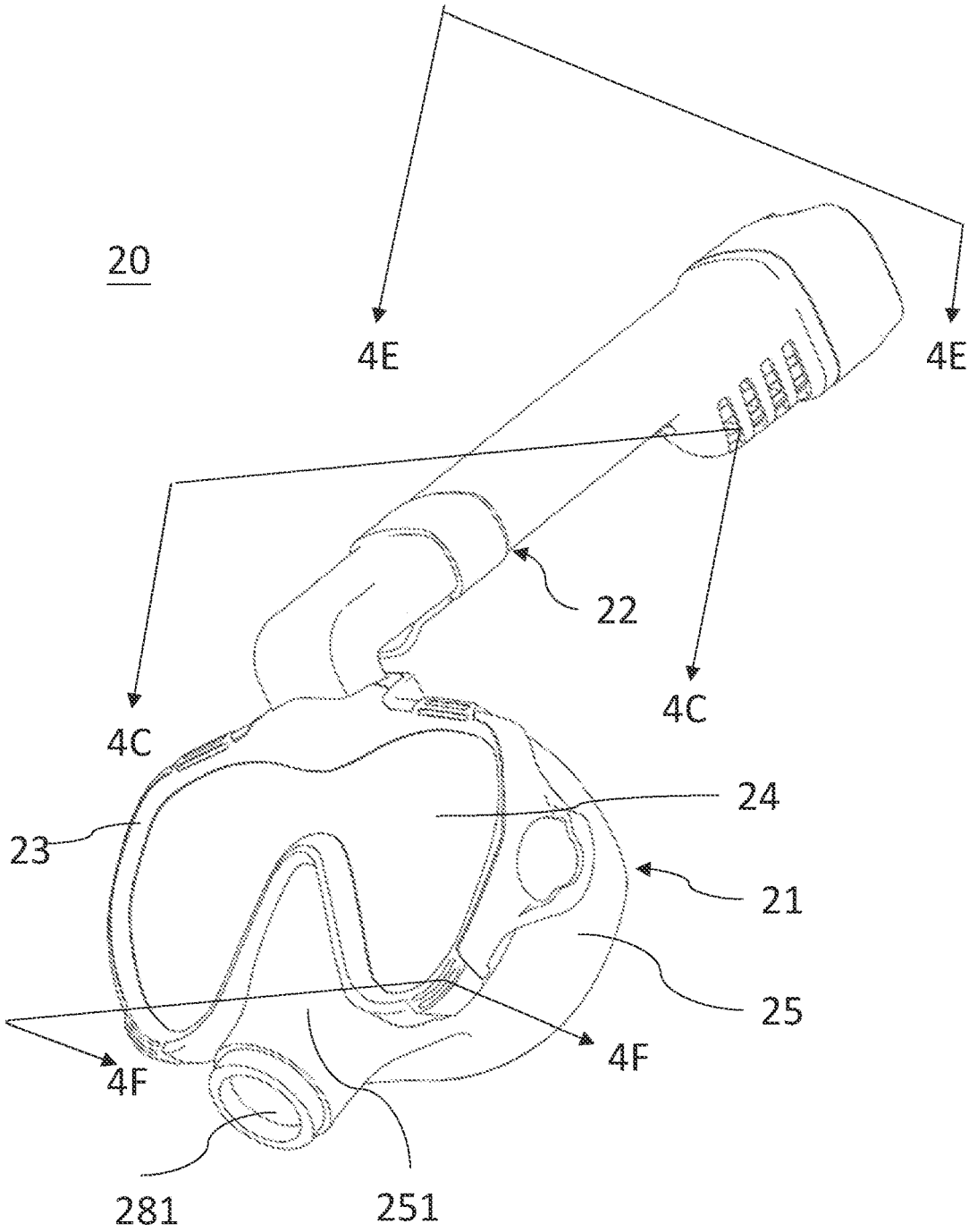
FIG. 4A is a front perspective view of the second embodiment of the present invention.
Figure 4B:
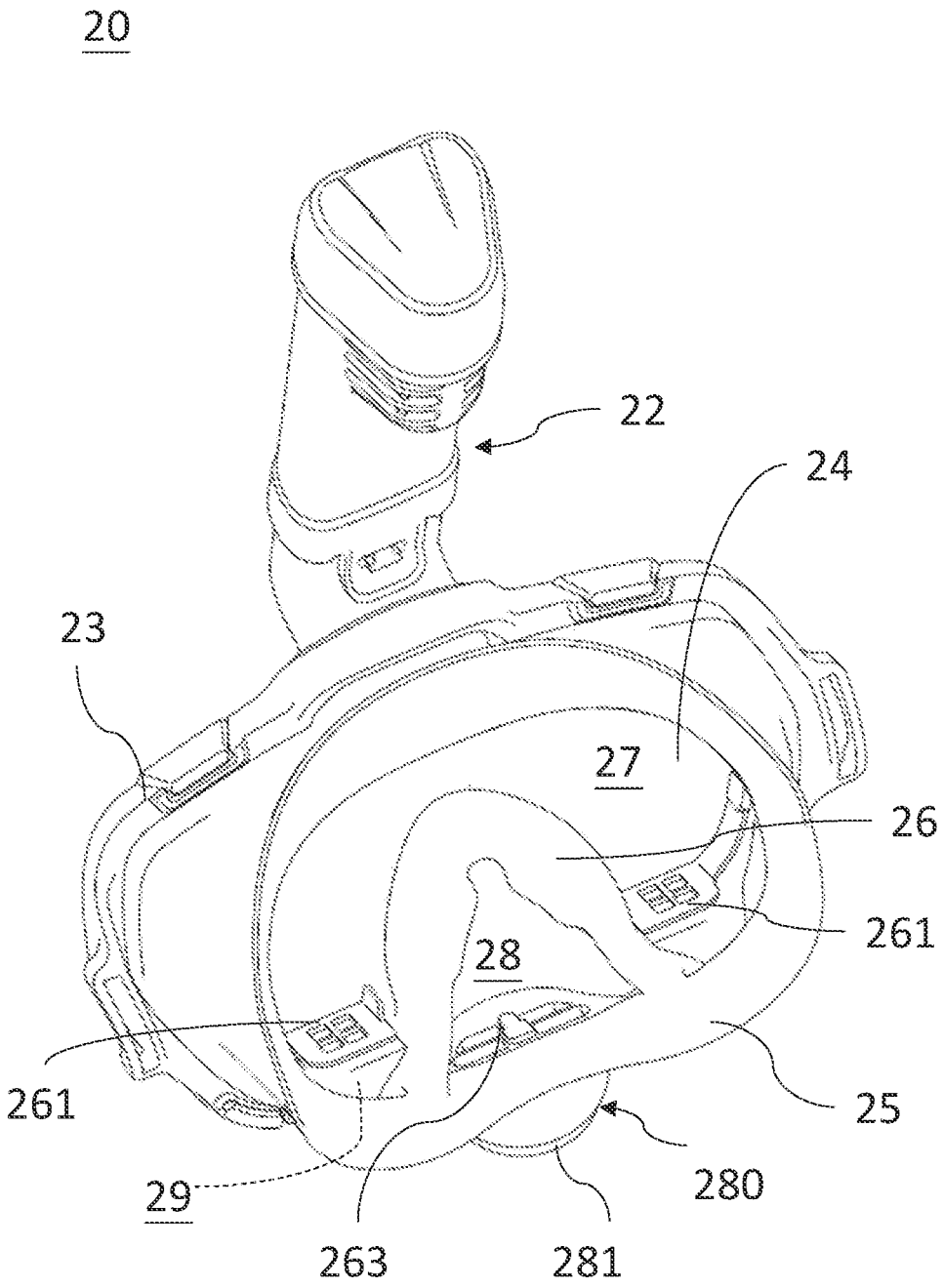
FIG. 4B is a perspective view after FIG. 4A.
Figure 4C:
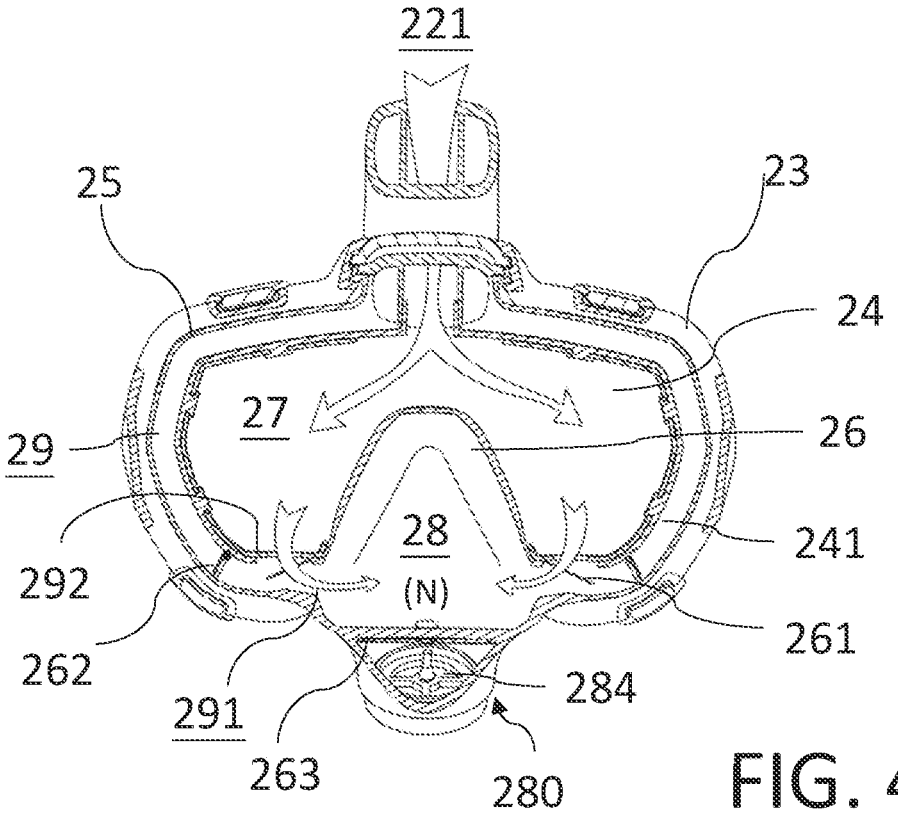
FIG. 4C is a coronal cross-sectional view taken along line 4C-4C in FIG. 4A, showing the intake airflow.
Figure 4D:
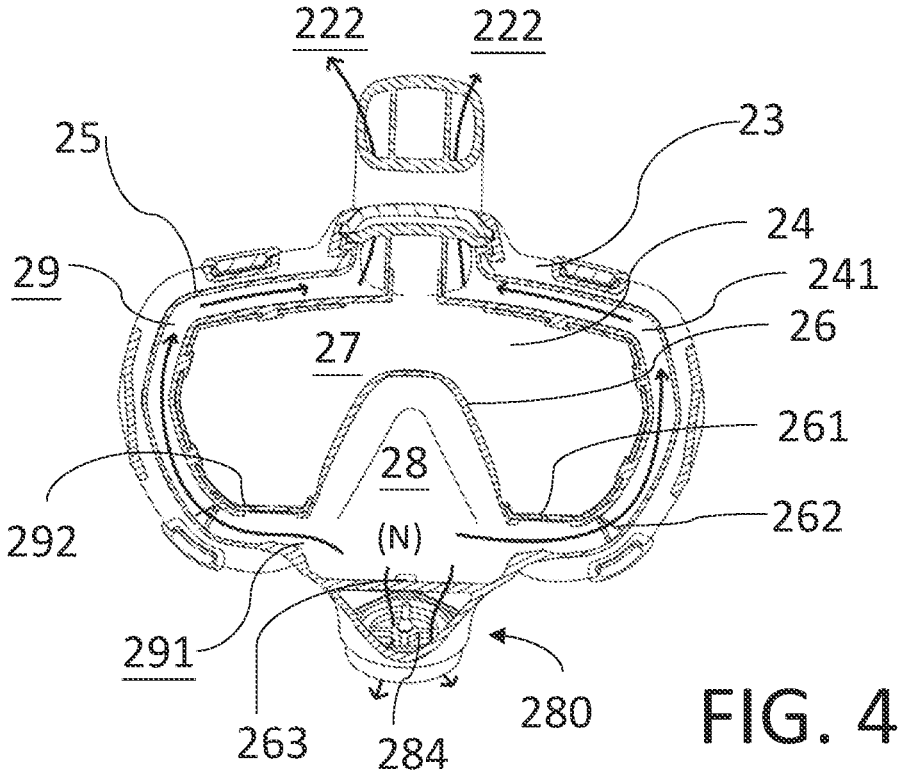
FIG. 4D is the same as FIG. 4C but showing the exhaust airflow.

Preferably, as shown in FIGS. 4C and 4D, the breathable mask 20 further includes a second one-way valve 262, wherein the intake passage is defined by the upper chamber 27 and the first one-way valve 261, and the exhaust passage is defined by the second one-way valve 261 and an exhaust tunnel 29. The exhaust tunnel 29 is formed by the waterproof sealing skirt 25 together with a peripheral edge 241 of the lens 24. In this embodiment, the first one-way valve 261 is disposed on a sidewall 292 at an entrance 291 of the exhaust tunnel 29, and the second one-way valve 262 is disposed inward further in the exhaust tunnel 29 in view of the first one-way valve 261. When the user's nose inhales, fresh air enters the lower chamber 28 from the intake conduit 221, through the upper chamber 27, the first one-way valve 261, and then the entrance 291 of the exhaust tunnel 29, for the user to inhale, as shown in FIG. 4C; whereas when the user's nose exhales, a part of the dirty air passes through the second one-way valve 262, enters the exhaust conduit 222 to be discharged outside through the exhaust tunnel 29, as shown in FIG. 4D.

Figure 4E:
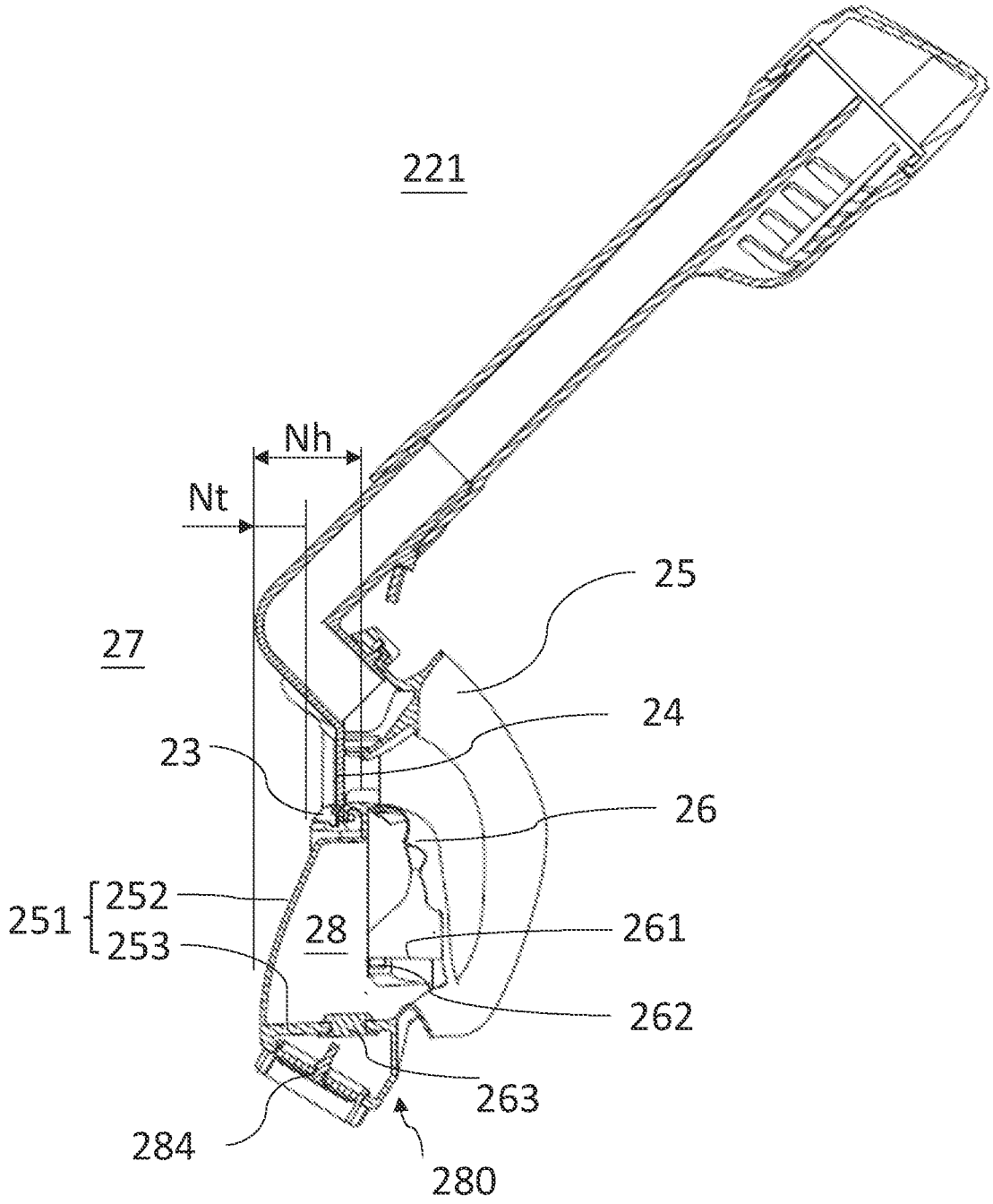
FIG. 4E is a sagittal cross-sectional view taken along line 4E-4E in FIG. 4A.

In reference to FIGS. 4D and 4E, the waterproof sealing skirt 25 further includes a nasal covering portion 251, which defines the lower chamber 27 together with the partition 26;

wherein the nasal covering portion 251 has a protruding area 252 and a bottom area 253 corresponding to the user's nostrils. The nasal connecting portion 280 is in fluid communication with the lower chamber 28 through the bottom area 253. In order to ensure that dirty air and water leaking in the mask 20 can remain at the bottom of the nasal connecting portion 280 and will not return to the lower chamber 28, more preferably, the bottom area 253 is provided with a third one-way valve 263, which only allows fluid to pass therethrough from the lower chamber 28 to the nasal connecting portion 280; thereby when the user exhales through the nose, a part of the dirty air passes through the third one-way valve 263 and is discharged outside through the purge valve 284 of the nasal connecting portion 280.

Figure 4F:
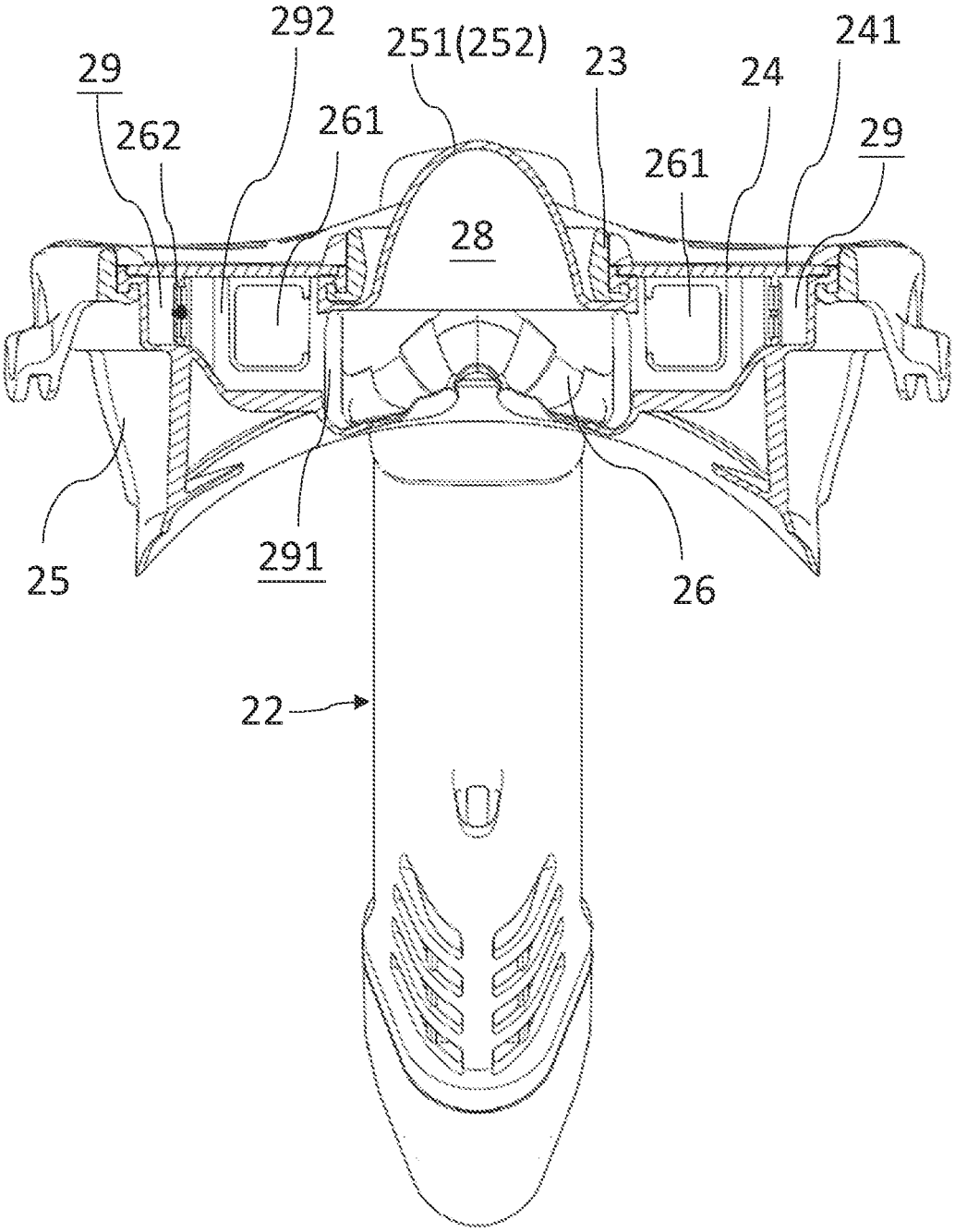
FIG. 4F is a transverse cross-sectional view taken along line 4F-4F in FIG. 4A.

Preferably, both the nasal covering portion 251 and the nasal connecting portion 280 are made of hard materials, having a Shore D hardness of 50-90, which is selected from polycarbonate (PC), Polypropylene (PP), polyethylene (PE), polyvinylchloride (PVC), acrylonitrile-butadiene-styrene copolymer (ABS) or combinations thereof. As shown in FIG. 4F, the nasal covering portion 251 can also be made of a softer material with Shore A hardness of 30-95, and the protruding area 252 gently extends forward from a rear edge of the main frame 23 to form a cross section having a single-crest mountain shape. The cross section has a maximum height (Nh) ranging between 20 mm and 35 mm. Alternatively, the protruding area 252 protrudes forward from the rear edge of the main frame to go beyond a lower, outer edge of the main frame 23 for a maximum extent (Nt) ranging between 5 mm and 20 mm.

The third embodiment of the present invention is mainly different from the first embodiment in that in the third embodiment, the mask is further in fluid communication with a three-way connector under the lower chamber thereof. The three-way connector is provided with a mouthpiece and a purge valve, not only can the user's mouth hold the mouthpiece, which has more sense of safety, but also allows the accumulated water in the mask to have space to be stored. In addition, the water leaking in the mask can be drained through the purge valve, and part of the air exhaled from the nose can also be discharged through the purge valve, making drainage and exhaust smoother.

Specifically, as shown in FIGS. 5A to 5D, a breathable mask 30 comprises a body 31 and a breathing tube 32, the breathing tube 32 being in fluid communication with an interior of the body 31. The breathing tube 32 includes an intake conduit 321 and an exhaust conduit 322 adjacent to the intake conduit 322. The body 31 includes a main frame 33, a lens 34 fitted in the main frame 31, and a waterproof sealing skirt 35, partially fitted with the main frame 33 and the lens 34. The waterproof sealing skirt 35 is suitable for fitting on a user's face; wherein the waterproof sealing skirt 35 has a partition 36, which divides the interior of the body 31 into an upper chamber 37 and the lower chamber 38, whereby when a user wears the breathable mask 30 through a fastening device (i.e., a head strap, not shown), the partition 36 is seated on the user's nose, and the user's eyes are accommodated in the upper chamber 37, whereas the user's nose is accommodated in the lower chamber 38. The mask 30 is characterized in that the body 31 further includes an intake passage, an exhaust passage, and a three-way connector 380. The intake passage is formed between the intake conduit 321 and the lower chamber 38, and is provided with a first one-way valve 361, wherein the first one-way valve 361 is provided for external fresh air to enter the lower chamber 38 through the intake passage. The exhaust passage is formed between the exhaust conduit 322 and the lower chamber 38, and the exhaust passage is provided for dirty air exhaled by the user to pass through and to be discharged outside. The three-way connector 380 has a nasal connecting portion 381, a mouth portion 382, and a drain portion 383 which are in fluid communication with one another, wherein the nasal connecting portion 381 is in fluid communication with the lower chamber 38, whereby when the user puts on the breathable mask 30, the mouth portion 382 is suitable for being contained in the user's mouth. In addition, the drain portion 383 is adapted to drain and exhaust downwards and forwards. In order to isolate dirty air more effectively, the mask 30 further comprises a second one-way valve 362. In this embodiment, the intake passage is defined by the upper chamber 37 and the first one-way valve 361, and the exhaust passage is defined by the second one-way valve 362 and an exhaust tunnel 39; wherein the exhaust tunnel 39 is formed by the waterproof sealing skirt 35 together with a peripheral edge 341 of the lens 34.

Figure 5A:
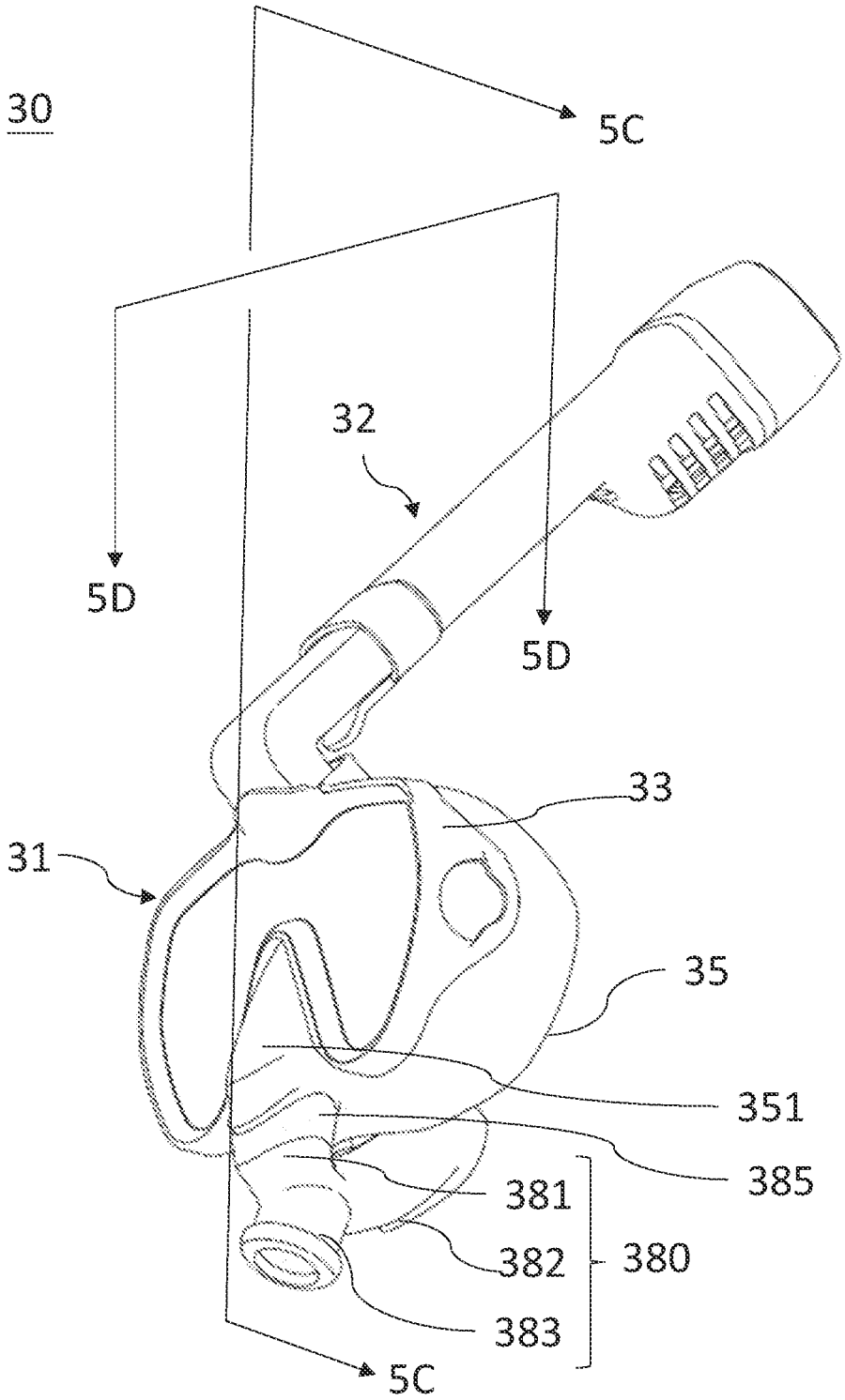
FIG. 5A is a front perspective view of a third embodiment of the present invention.
Figure 5B:
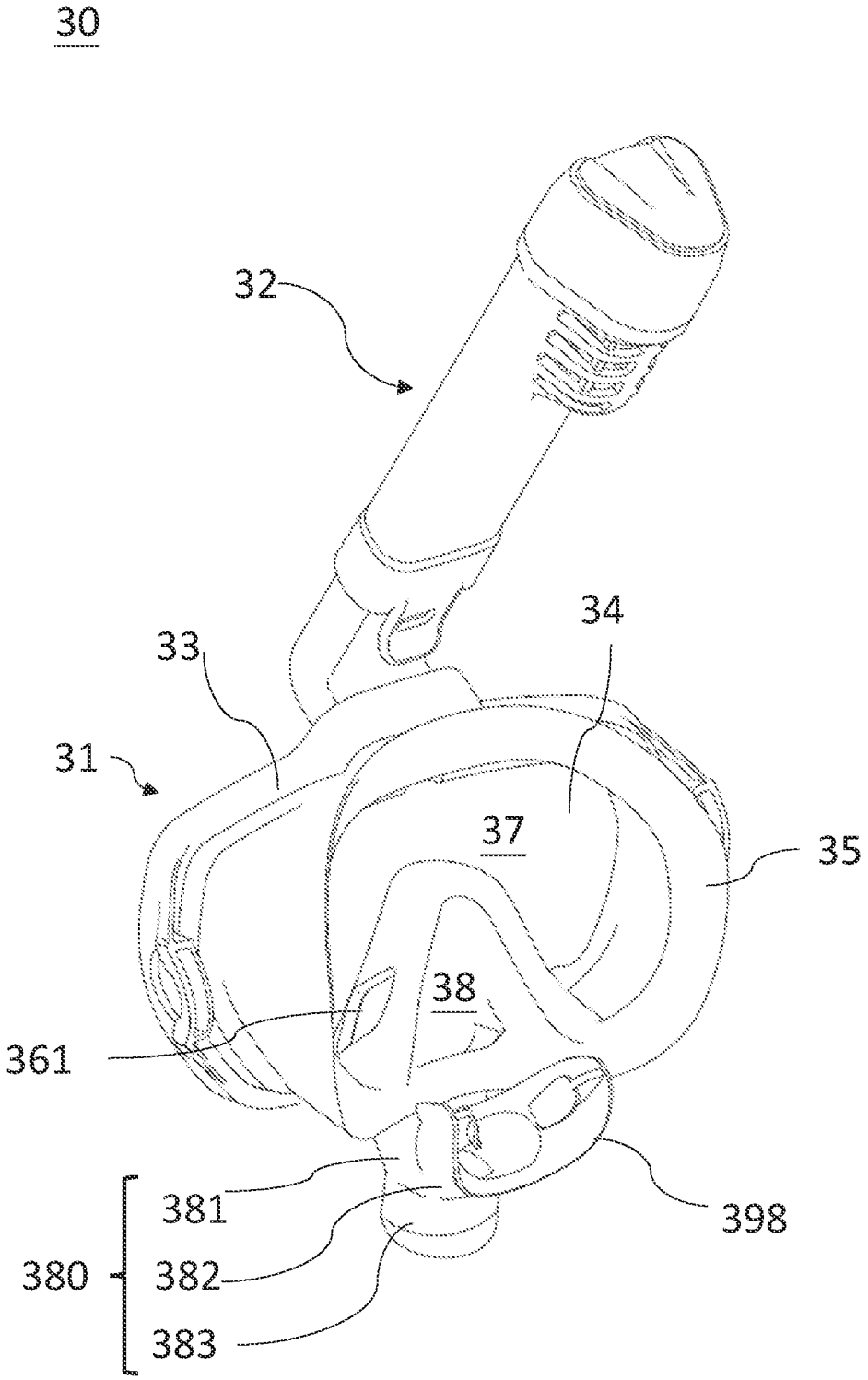
FIG. 5B is a rear perspective view of FIG. 5A.
Figure 5C:
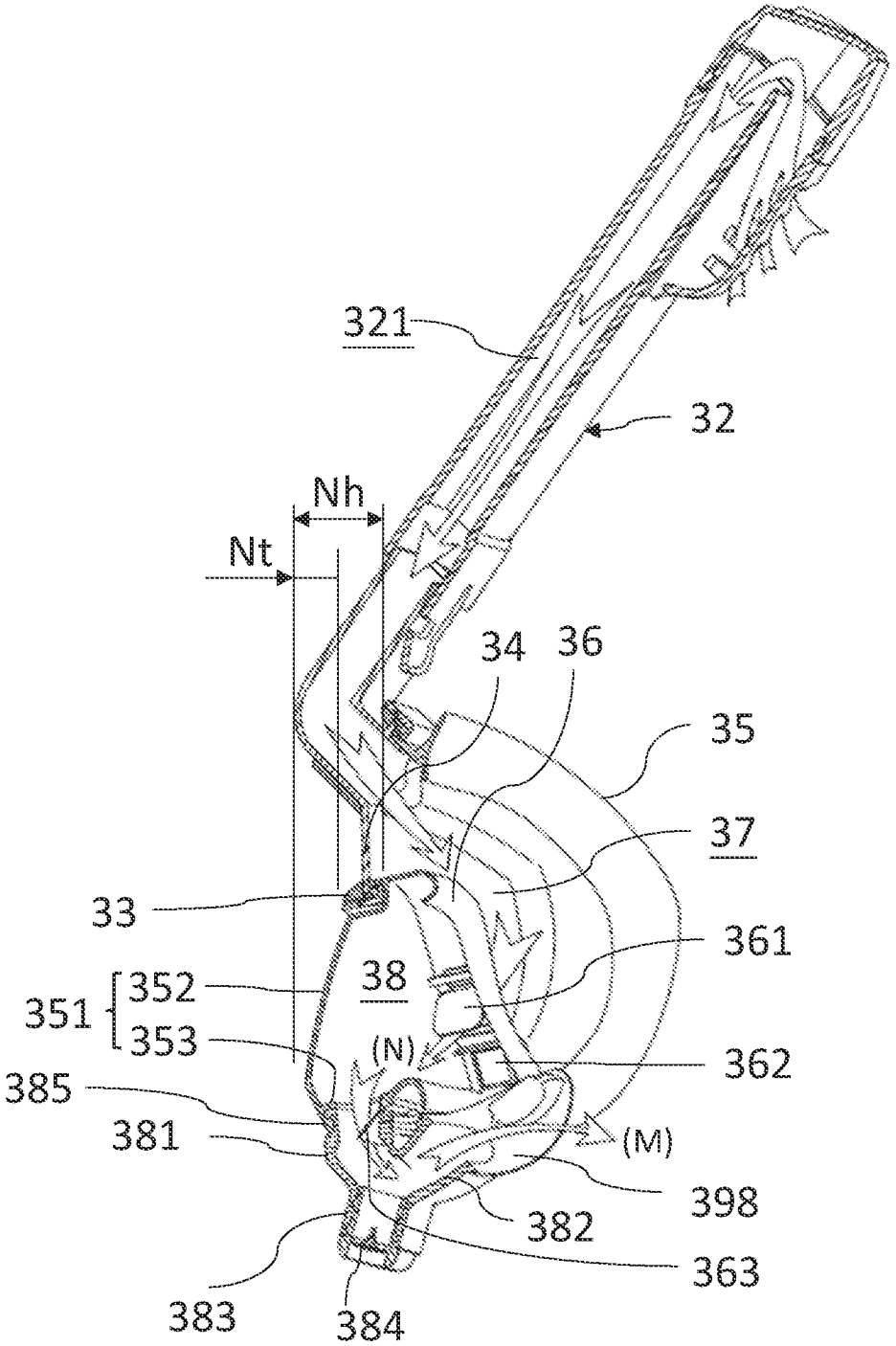
FIG. 5C is a sagittal cross-sectional view taken along line 5C-5C in FIG. 5A, showing the intake airflow.
Figure 5D:
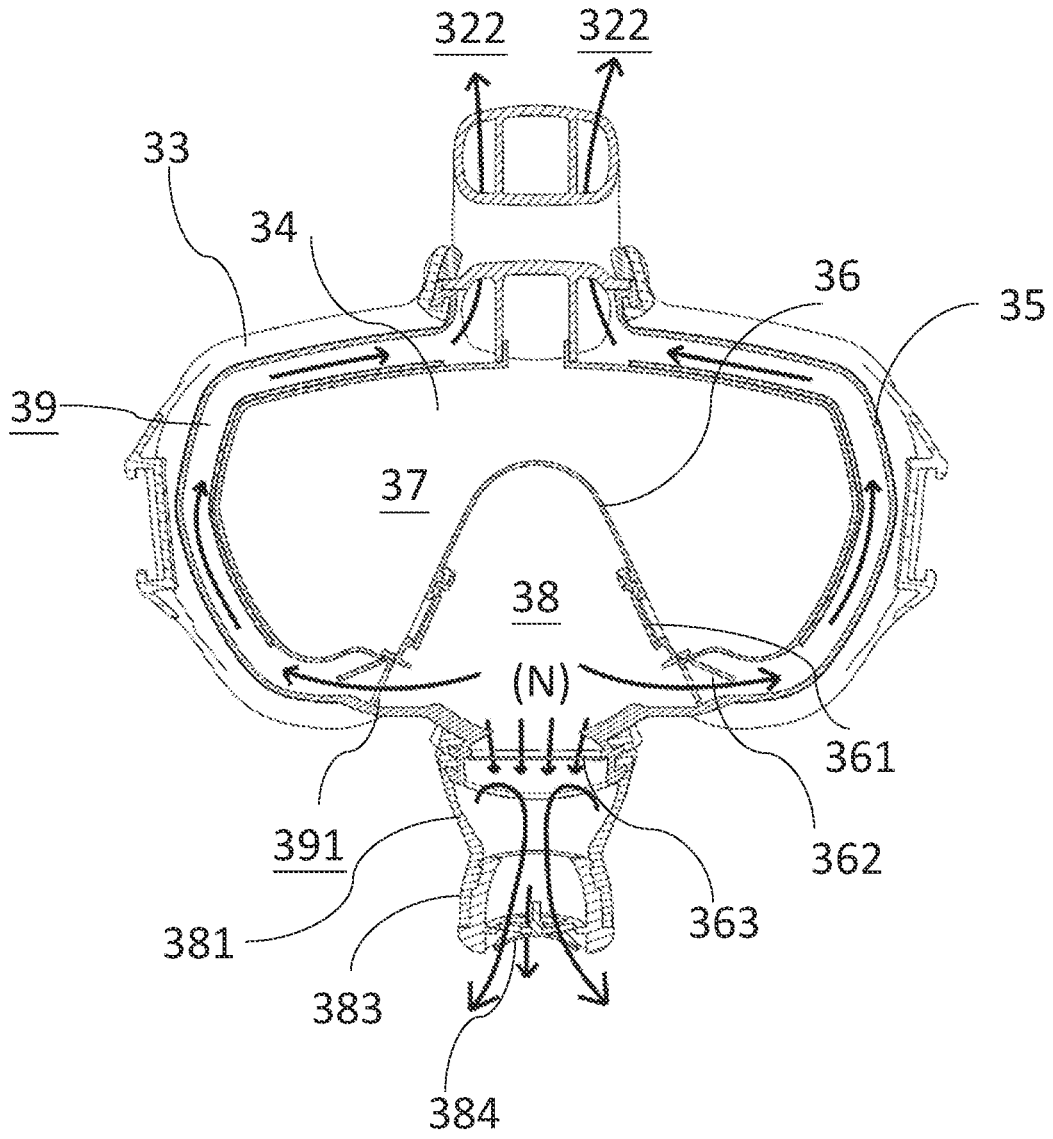
FIG. 5D is a coronal cross-sectional view taken along line 5D-5D in FIG. 5A, showing the exhaust airflow.

Preferably, as shown in FIGS. 5B-5D, the first one-way valve 361 is disposed on the partition 36, and the second one-way valve 362 is disposed at an entrance 391 of the exhaust tunnel 39. When the user's nose (N) inhales (see FIG. 5C), the fresh air passes from the intake conduit 321, through the upper chamber 37 and the first one-way valve 361, to the lower chamber 38, to supply the user's nose to inhale; whereas when the user's nose (N) exhales (see FIG. 5D), part of the dirty air passes through the second one-way valve 362, enters the exhaust conduit 322 through the exhaust tunnel 39, and is discharged outside. The waterproof sealing skirt 35 further includes a nasal covering portion 351, which defines the lower chamber 38 together with the partition 36; wherein the nasal covering portion 351 has a protruding area 352 and a bottom area 353 corresponding to the user's nostrils. The nasal connecting portion 351 is in fluid communication with the lower chamber 38 through the bottom area 353. Preferably, the nasal covering portion 351 is made of hard material, having a Shore D hardness of 50-90, which is selected from polycarbonate (PC), Polypropylene (PP), polyethylene (PE), polyvinylchloride (PVC), acrylonitrile-butadiene-styrene copolymer (ABS) or combinations thereof. As shown in FIG. 5C, the nasal covering portion 351 can also be made of a softer material with Shore A hardness of 30-95, and the protruding area 352 gently extends forward from a rear edge of the main frame 33 to form a cross section having a single-crest mountain shape. The cross section has a maximum height (Nh) ranging between 20 mm and 35 mm. Alternatively, the protruding area 352 protrudes forward from the rear edge of the main frame 33 to go beyond a lower, outer edge of the main frame 33 for a maximum extent (Nt) ranging between 5 mm and 20 mm.

In order to better match the face shapes of different users and allow users to wear more comfortably, the nasal connecting portion 381 and the bottom area 353 is provided with a flexible portion 385 therebetween to promote a movable range of the three-way connector 380. The bottom area 353 is provided with a third one-way valve 363, which only allows fluid to pass therethrough from the lower chamber 38 to the nasal connecting portion 381; thereby when the user's mouth (M) inhales (see FIG. 5C), the fresh air passes through the third one-way valve 363 and the mouth portion 382 to supply the user. When the user's nose (N) exhales (see FIG. 5D), the dirty air passes through the third one-way valve 363 and the nasal connecting portion 381, and is discharged outside through the drain portion 383. When the user's mouth (M) exhales (see FIG. 5D again), the dirty air from the mouth portion 382 runs toward the drain portion 383 and then is discharged through the purge valve 384 disposed on the end of the drain portion 383. Meanwhile, if water leaking in the mask 30 has been accumulated in the three-way connector 380 (usually mainly accumulated in the drain portion 383), it will be drained outward through the purge valve 384 along with the air exhaled by the user's mouth. This way, the exhaled dirty air from the mouth, as well as the water drainage, has no sense to splash back into the lower chamber 38 because of being blocked by the third one-way valve 363.

Figure 6:
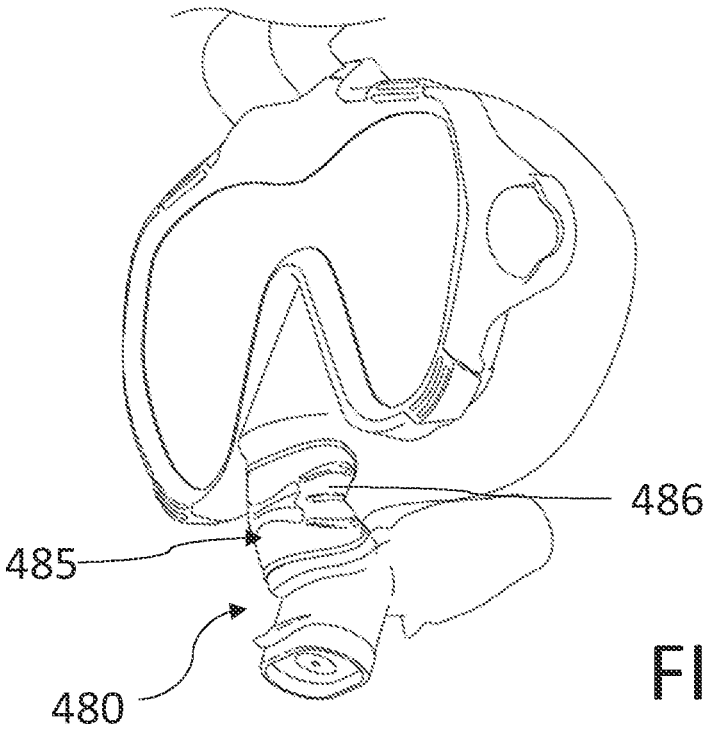
FIG. 6 is another configuration of the three-way connector in the third embodiment of the present invention.
Figure 7:
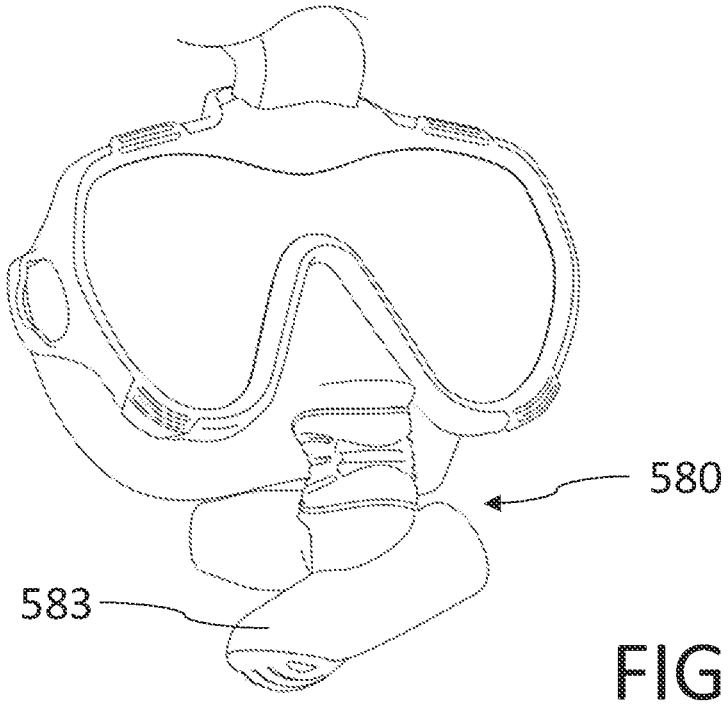
FIG. 7 is yet a further configuration of the three-way connector in the third embodiment of the present invention.
Figure 8A:
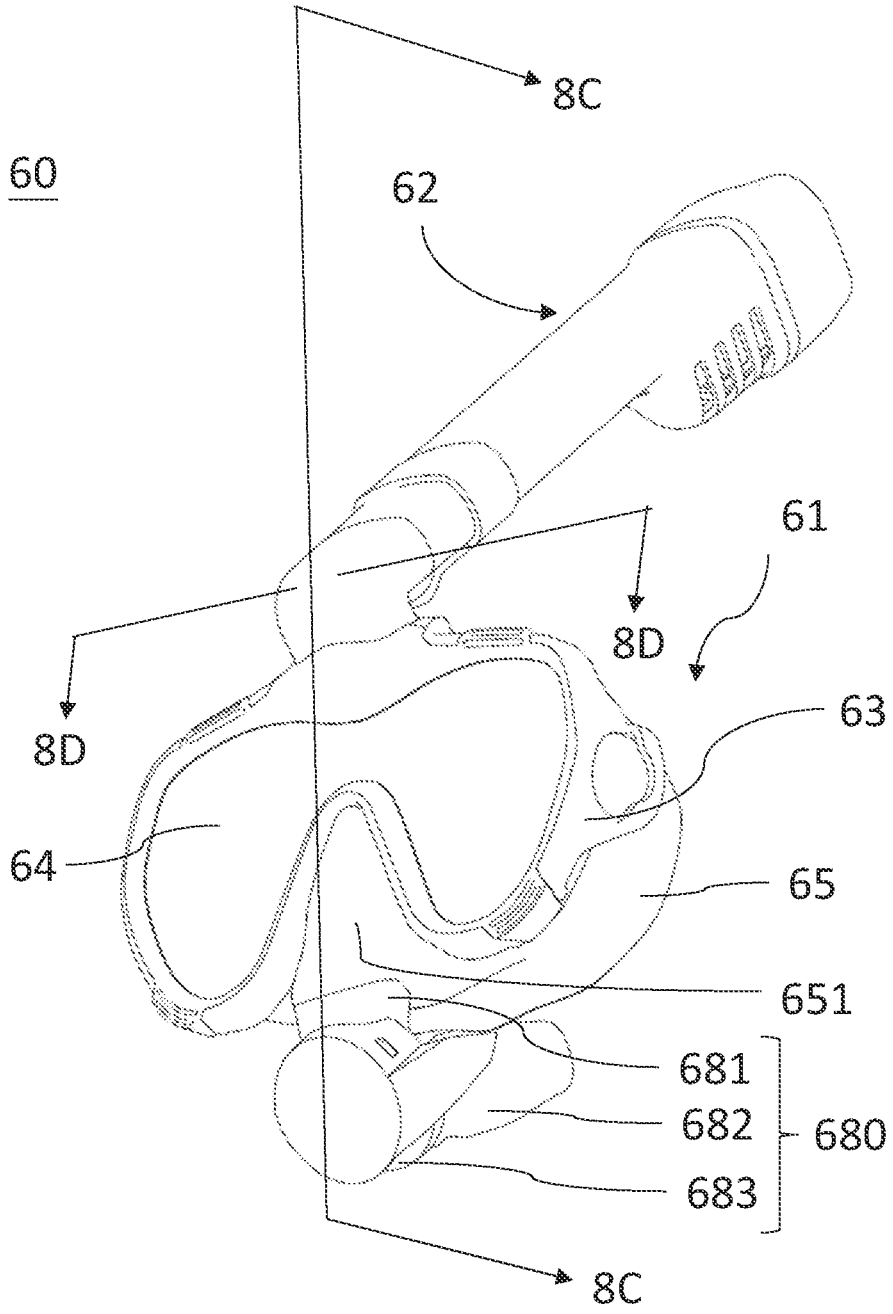
FIG. 8A is an extended configuration of the three-way connector in the third embodiment of the present invention.
Figure 8B:
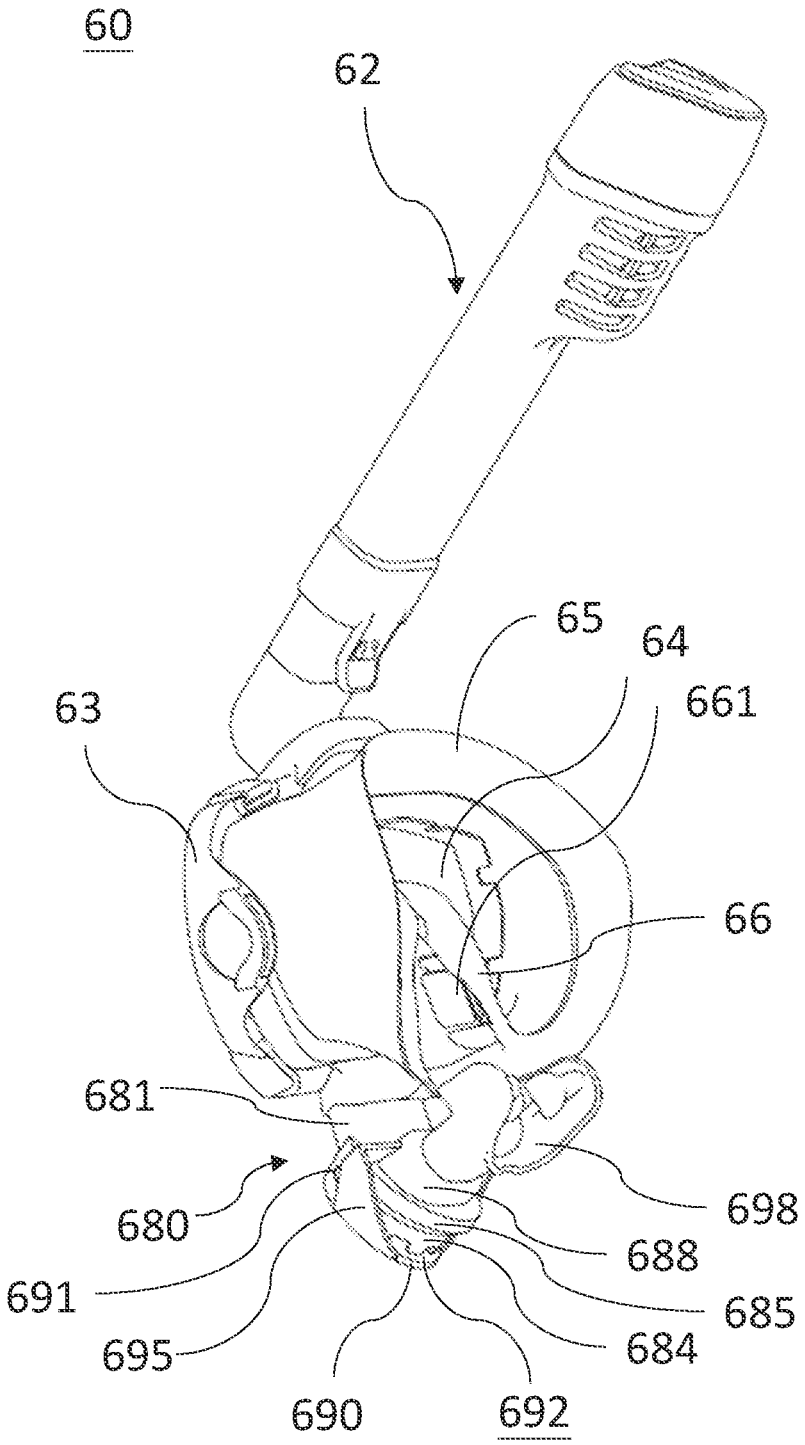
FIG. 8B is a perspective rear view of FIG. 8A.
Figure 8C:
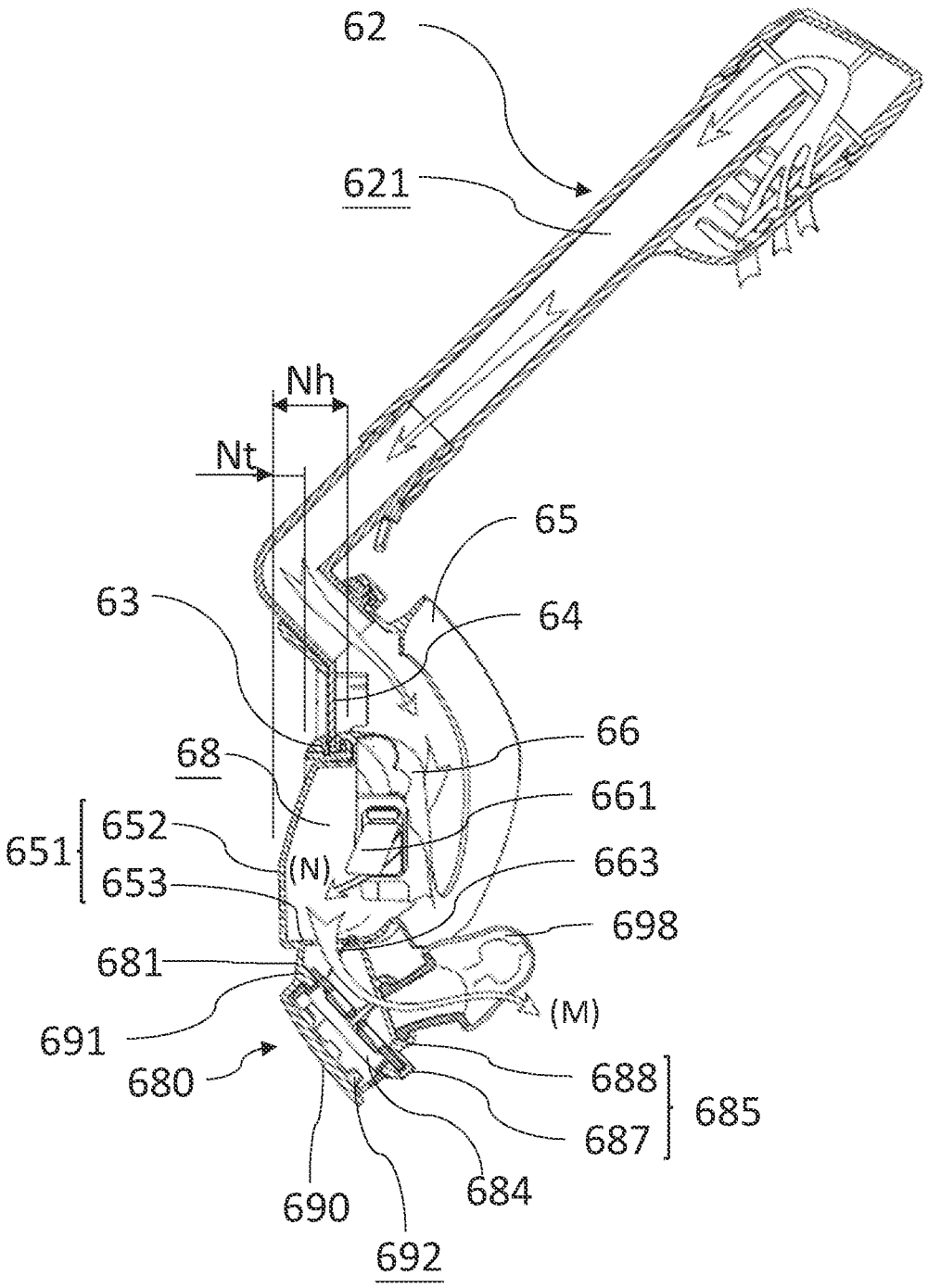
FIG. 8C is a sagittal cross-sectional view taken along the line 8C-8C of FIG. 8A, showing the intake airflow.
Figure 8D:
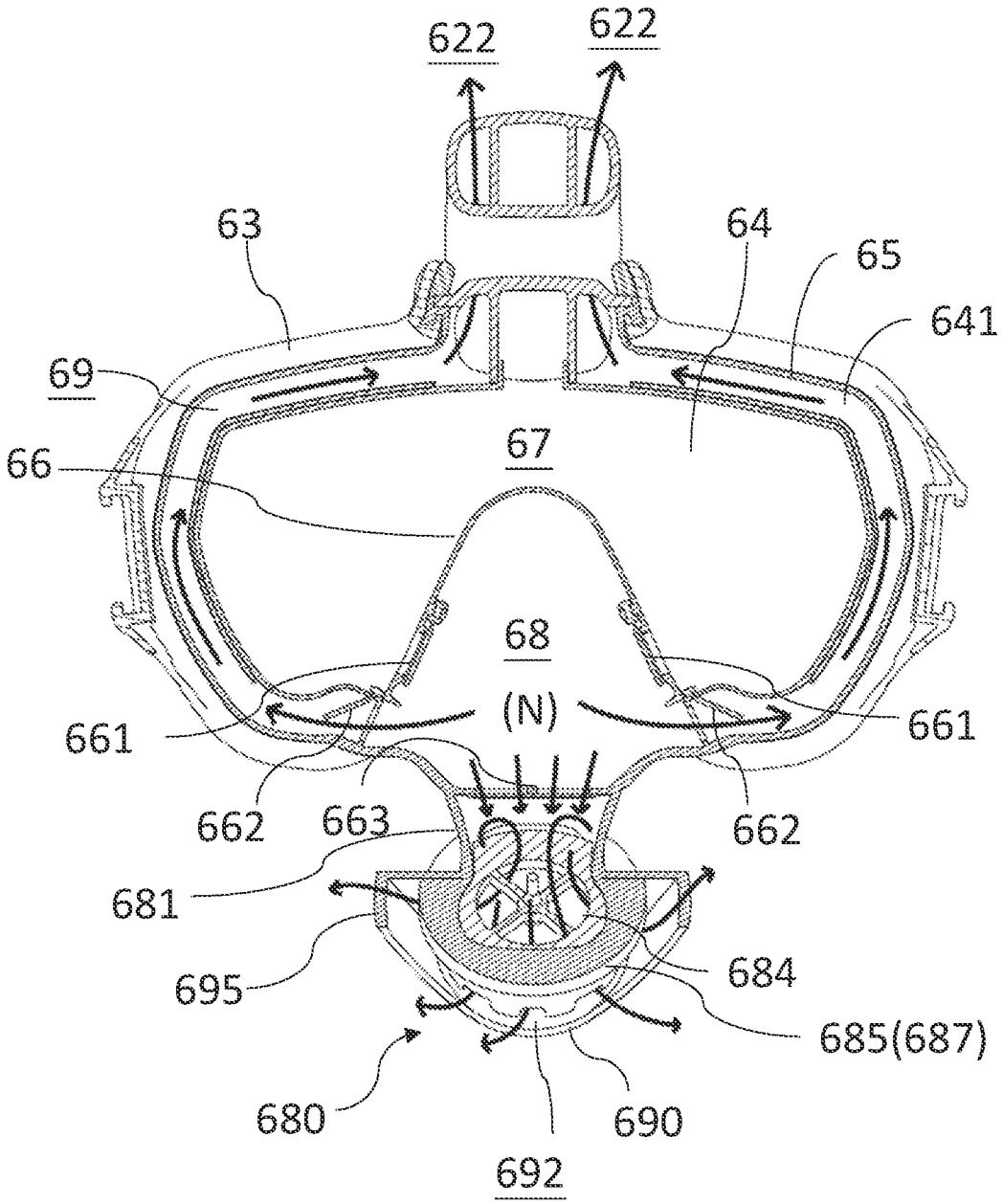
FIG. 8D is a coronal cross-sectional view taking along line 8D-8D, showing the exhaust airflow.

The design of the flexible portion 385 is not limited to the above. It is also feasible to provide an independent flexible connector 485 by elongating a flexible portion with a pleated sidewall 486 in order to increase the movable range of the three-way connector 480, as shown in FIG. 6. And the design of the three-way connector is not limited to the above as well. The internal space of the drain portion 583 of the three-way connector 580 can be increased, so that it can store more water leaking in the mask. FIG. 7 shows one of the examples, in which the drain portion 583 drains and exhausts downwards and sidewards.

Continuing the third embodiment of the present invention, the design of the three-way connector can also be changed as shown in FIGS. 8A to 8D. When the user exhales in the water, the air bubbles of drainage and exhaust are not directed upward, but toward the sides of the user's face, which will not hinder the user's view of the scenery in the water.

As shown in FIGS. 8A to 8D, a breathable mask 60 comprises a body 61 and a breathing tube 62, the breathing tube 62 being in fluid communication with an interior of the body 61. The breathing tube 62 including an intake conduit 621 and an exhaust conduit 622 adjacent to the intake conduit 621. The body 61 includes a main frame 63, a lens 64 fitted in the main frame 63, and a waterproof sealing skirt 65, partially fitted with the main frame 63 and the lens 64. The waterproof sealing skirt 65 is suitable for fitting on a user's face; wherein the waterproof sealing skirt 65 has a partition 66, which divides the interior of the body 61 into an upper chamber 67 and the lower chamber 68, whereby when a user wears the breathable mask 60 through a fastening device (i.e., a head strap, not shown), the partition 66 is seated on the user's nose, and the user's eyes are accommodated in the upper chamber 67, whereas the user's nose is accommodated in the lower chamber 68. The mask 60 is characterized in that the body 61 further includes an intake passage, an exhaust passage, and a three-way connector 680. The intake passage is formed between the intake conduit 621 and the lower chamber 68, and is provided with a first one-way valve 661, wherein the first one-way valve 661 is provided for external fresh air to enter the lower chamber 68 through the intake passage. The exhaust passage is formed between the exhaust conduit 622 and the lower chamber 68, and the exhaust passage is provided for dirty air exhaled by the user to pass through and to be discharged outside. The three-way connector 680 has a nasal connecting portion 681, a mouth portion 682, and a drain portion 683 which are in fluid communication with one another, wherein the nasal connecting portion 681 is in fluid communication with the lower chamber 68, whereby when the user puts on the breathable mask 60, the mouth portion 682 is suitable for being contained in the user's mouth. In addition, preferably, the drain portion 583 is adapted to drain and exhaust downwards and forwards. The mask 60 further comprises a second one-way valve 662, wherein the intake passage is defined by the upper chamber 67 and the first one-way valve 661, and the exhaust passage is defined by the second one-way valve 662 and an exhaust tunnel 69; and wherein the exhaust tunnel 69 is formed by the waterproof sealing skirt 65 together with a peripheral edge 641 of the lens 64.

This extended embodiment shown in FIGS. 8A to 8D is almost the same as the embodiment shown in FIGS. 5A to 5D. Only the design of the three-way connector 680 is altered. Specifically, the drain portion 683 includes a base 685 extending downward from the nasal connecting portion 681 The base 685 has a first connecting portion 687 and the second connecting portion 688 opposing to the first connecting portion 687. The first connecting portion 687 is suitable for accommodating a purge valve 684 fixed therein. The mouth portion 682 is defined by the second connecting portion 688 and a mouthpiece 698 fixed thereto. The drain portion 683 further includes a baffle 690, wherein the baffle 690, the purge valve 684 and the first connecting portion 687 jointly define the drain portion 683. The baffle 690 extends downwards from the nasal connecting portion 681 and faces the purge valve 684. Preferably, the baffle 690 and the purge valve 684 are snap-fitted to form a gap 692 therebetween. When the user exhales, the dirty air and/or accumulated water can be discharged laterally through the gap 692. More preferably, there are guide fins 695 which extend from the two sides of the baffle 690 to assist drainage and exhaust along desired directions, i.e., sideward and downward, so as to prevent air bubbles from going upward.

The following is a further description of the intake and exhaust flow. The first one-way valve 661 is disposed on the partition 66. When the user's nose (N) inhales (See FIG. 8C), fresh air passes through the upper chamber 67 from the intake conduit 621 and enters the lower chamber 68 for the user's nose to inhale. When the user's nose (N) exhales (FIG. 8D), a part of dirty air enters the exhaust tunnel 69, through the second one-way valve 662 disposed on the entrance of the exhaust tunnel 69, and then runs through the exhaust conduit 622 to be discharged outside. The waterproof sealing skirt 65 further includes a nasal covering portion 651, which, together with the partition 66, defines the lower chamber 68; wherein the nasal covering portion 651 has a protruding area 652 and a bottom area 653, and the bottom area 653 is suitable for corresponding to the user's nostrils. The nasal connecting portion 681 is in fluid communication with the lower chamber 68 through the bottom area 653.

More preferably, the bottom area 653 is provided with a third one-way valve 663, which only allows fluid to pass therethrough from the lower chamber 68 to the nasal connecting portion 681. When the user's mouth (M) inhales (see FIG. 8C), fresh air passes through the third one-way valve 663 and the mouth portion 682 to supply the user. When the user exhales through the nose (N) (see FIG. 8D), dirty air runs through the third one-way valve 663 and the nasal connecting portion 681, and then is discharged outside through the drain portion 683; whereas when the user's mouth (M) exhales (see FIG. 8D again), the dirty air is discharged outward from the mouth portion 682 toward the drain portion 683, and water accumulated in the three-way connector 680 (usually mainly accumulated in the drain portion 683) is also forced out through the drain portion 683. The dirty air and the accumulated water running through the drain portion 683 hits the baffle 690 first and is then discharged downward and outward along the guide fins 695 extending on both sides of the baffle 690. This way, the exhaled dirty air from the mouth, as well as the water drainage, has no sense to splash back into the lower chamber 68 because of being blocked by the third one-way valve 663.

In this extended third embodiment, the material used for and the cross section of the nasal covering portion 651 are similar to those of the previous embodiments. Specifically, if it is made of hard material, it has a Shore D (Shore D) hardness of 50-90, which is selected from polycarbonate (PC), Polypropylene (PP), polyethylene (PE), polyvinylchloride (PVC), acrylonitrile-butadiene-styrene copolymer (ABS) or combinations thereof. If the nasal covering portion 651 is made of softer material, preferably with Shore A hardness of 30-95, the protruding area 652 gently extends forward from a rear edge of the main frame 63 to form a cross section having a single-crest mountain shape. The cross section has a maximum height (Nh) ranging between 20 mm and 35 mm. Alternatively, the protruding area 652 protrudes forward from the rear edge of the main frame 63 to go beyond a lower, outer edge of the main frame 63 for a maximum extent (Nt) ranging between 5 mm and 20 mm.

In addition to the above-mentioned preferred embodiments that have described in details the structure and operation mode of the technology of the present invention, any other embodiments transformed based on the concept of the present invention, as follows for instance, shall belong to the equivalents of the present invention, and shall not limit the scope of the literal meanings as set forth in the last paragraph.

The air intake and exhaust mechanisms of the above embodiments, such as the first one-way valve, the second one-way valve, the intake passage, the exhaust passage, the exhaust tunnel, and the exhaust conduit, being all symmetrically arranged in the mask are the best mode. Taking only one of them for illustration is just for the sake of convenience and easy comprehension. It does not mean to limit their numbers.

Any type of the breathing tube is feasible, provided that it can exchange air for the mask body with the outside when its top is above the water surface, and it can block air exchange when its top is under the water surface. A dry-type snorkel is the best choice, but it is not limited to the form or the exact location as to where it is on the top of the mask body.

Figure 2A:
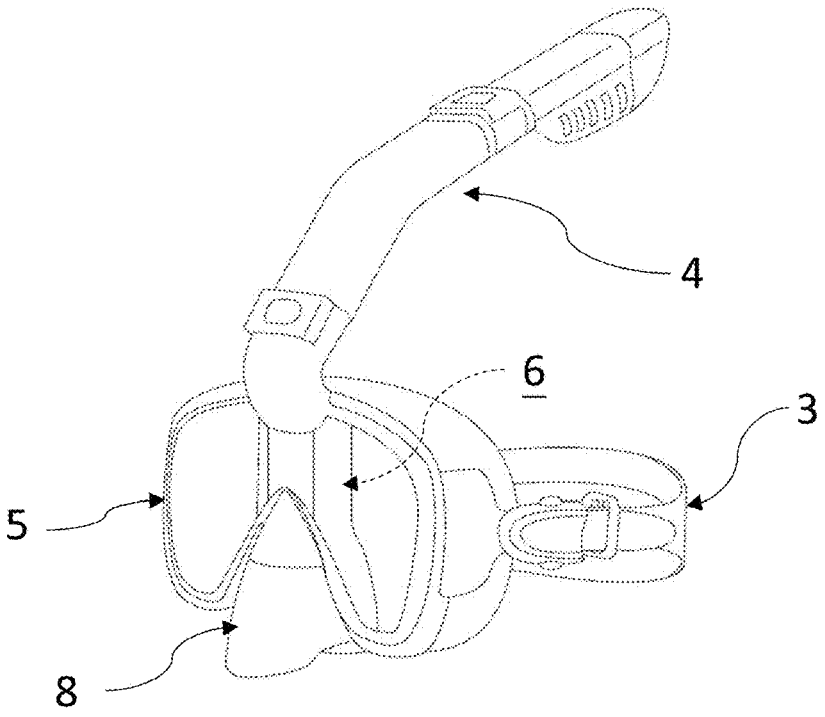
FIG. 2A (PRIOR ART)
FIG. 2A is a schematic diagram of another prior art snorkeling mask.
Figure 2B:
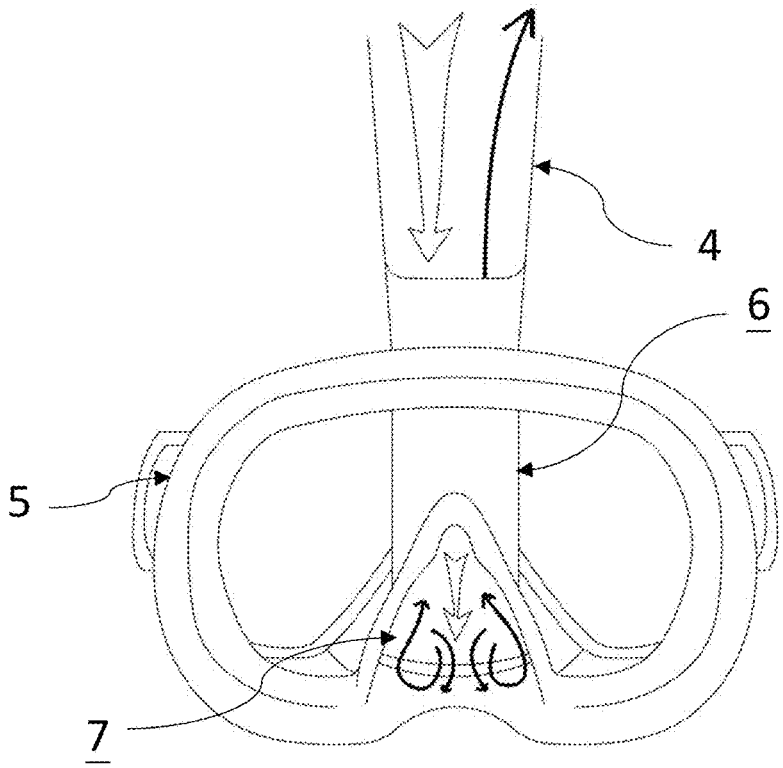
FIG. 2B (PRIOR ART)
FIG. 2B is a schematic partial rear view of FIG. 2A, showing intake and exhaust airflow.
Figure 2C:
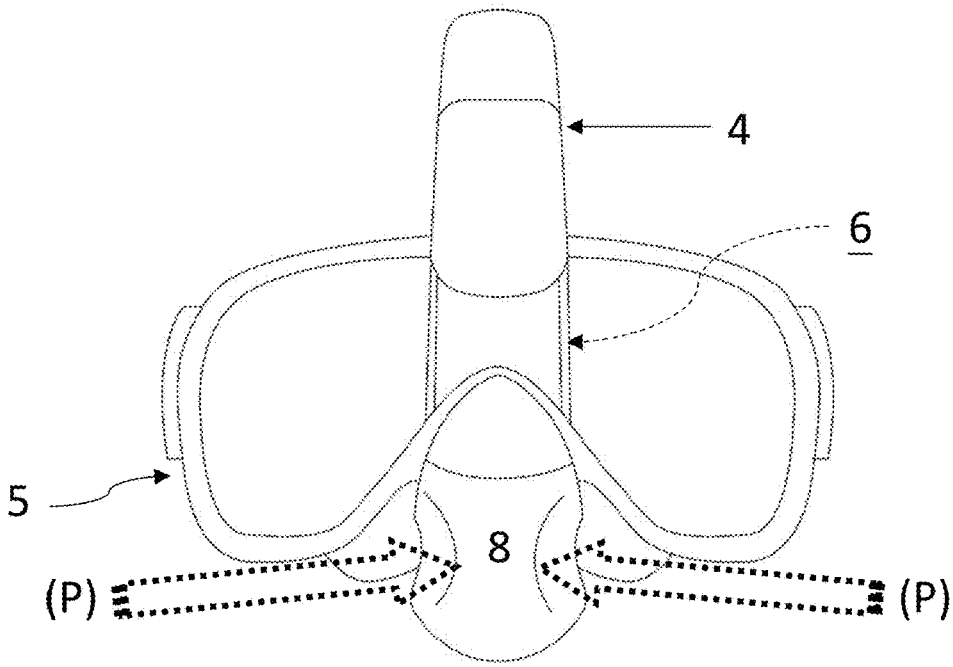
FIG. 2C (PRIOR ART)
FIG. 2C is a schematic partial front view of FIG. 2A, showing the deformation of the nose pocket being squeezed by water pressure (P).

The head straps as described are all similar to those shown in FIG. 2A, but are not limited in form, and are not shown in the drawings of the present invention, so as not to hinder the other elements required to be seen for description.

The mentioned two first one-way valves are preferably arranged symmetrically on the partition or on both sides of the partition. The objective of installing the second one-way valve is to make the air intake and exhaust airflows further independent, thereby when the user breathes, the small amount of dirty air accumulated in the exhaust passage will not be mixed with the clean air in the next inhalation cycle. That is, the arrangement of the second one-way valve is not a must.

The mentioned main frame and the lens are not limited to only shielding the user's eyes, but it is also feasible to shield both of the user's eyes and nose. Furthermore, in the case that the lens only covering the eyes is not limited to a single lens bridging the left and right, but two independent lenses on the left and right, respectively, are also feasible.

The mentioned third one-way valve is not limited to be located in the bottom area, it can also be located in any position of the nasal connecting portion, provided that the fluid in the nasal connecting portion can be prevented from flowing back to the lower chamber. Same, the installation of the third one-way valve is not a must.

The mentioned three-way connector and the baffle are not limited to any form.

The first, second, and third one-way valves are not limited to any form. They can be selected from any valve device with mushroom-shaped (circular), pivotal (mostly square) or others that can provide one-way fluid communication.

The mentioned waterproof sealing skirt does not necessarily have to be integrally formed. It is also feasible that for example, the protruding area and the bottom area of the nasal covering portion are designed by two separate components, or, the three-way connector and the nasal covering portion are separate components, provided that there is a considerable capability of waterproofness therebetween after assembly.

The mentioned nasal covering portion made of the softer material mainly has a secondary function that allows the user to pinch the nose to do, for example, a Frenzel equalization.

What is claimed is:

1. A breathable mask comprising a body and a breathing tube, the breathing tube being in fluid communication with an interior of the body; the breathing tube including an intake conduit and an exhaust conduit adjacent to the intake conduit, the body including:

a main frame configured to only encircle a user's eyes a lens fitted in the main frame;

a waterproof sealing skirt, partially fitted with the main frame and the lens, the waterproof sealing skirt being suitable for fitting on a user's face; wherein the waterproof sealing skirt has a partition, which divides the interior of the body into an upper chamber and a lower chamber, whereby when a user wears the breathable mask through a fastening device, the partition is seated on the user's nose, and the user's eyes are accommodated in the upper chamber, whereas the user's nose is accommodated in the lower chamber;

characterized in that the lens is configured to only cover the user's eyes, the waterproof sealing skirt further includes a soft nasal covering portion, which defines the lower chamber together with the partition; wherein the nasal covering portion has a protruding area and a bottom area configured to correspond to the user's nostrils; the body further includes:

an intake passage being formed between the intake conduit and the lower chamber, and is provided with a first one-way valve, wherein the first one-way valve is disposed on the partition, and the first one-way valve is provided for external fresh air to enter the lower chamber through the intake passage;

an exhaust passage being formed between the exhaust conduit and the lower chamber, and the exhaust passage being provided for dirty air exhaled by the user to pass through and be discharged outside;

wherein the intake passage and the exhaust passage are in fluid independent of each other.

2. The breathable mask according to claim 1, further comprising a second one-way valve, wherein the intake passage is defined by the upper chamber and the first one-way valve, and the exhaust passage is defined by the second one-way valve and an exhaust tunnel; wherein the exhaust tunnel is formed by the waterproof sealing skirt together with a peripheral edge of the lens.

3. The breathable mask according to claim 2, wherein the second one-way valve is disposed on the partition, and when the user inhales, fresh air passes from the intake conduit, through the upper chamber, and enters the lower chamber through the first one-way valve to supply the user's nose to inhale; when the user exhales, the dirty air passes through the second one-way valve and the exhaust tunnel, and is discharged outside through the exhaust conduit.

4. The breathable mask according to claim 1, wherein the nasal covering portion is made of a material with Shore A hardness of 30-95, and the protruding area extends forward from a rear edge of the main frame to form a cross section having a single-crest mountain shape.

5. The breathable mask according to claim 4, wherein the cross section has a maximum height (Nh) ranging between 20 mm and 35 mm.

6. The breathable mask according to claim 4, wherein the protruding area protrudes forward from the rear edge of the main frame to go beyond a lower, outer edge of the main frame for a maximum extent (Nt) ranging between 5 mm and 20 mm.

7. A breathable mask comprising a body and a breathing tube, the breathing tube being in fluid communication with an interior of the body; the breathing tube including an intake conduit and an exhaust conduit adjacent to the intake conduit, the body including:

a main frame configured to only encircle a user's eyes a lens fitted in the main frame;

a waterproof sealing skirt, partially fitted with the main frame and the lens, the waterproof sealing skirt being suitable for fitting on a user's face; wherein the waterproof sealing skirt has a partition, which divides the interior of the body into an upper chamber and a lower chamber, whereby when a user wears the breathable mask through a fastening device, the partition is seated on the user's nose, and the user's eyes are accommodated in the upper chamber, whereas the user's nose is accommodated in the lower chamber;

characterized in that the lens is configured to only cover the user's eyes, the waterproof sealing skirt further includes a soft nasal covering portion, which defines the lower chamber together with the partition; wherein the nasal covering portion has a protruding area and a bottom area configured to correspond to the user's nostrils; the body further includes:

an intake passage being formed between the intake conduit and the lower chamber, and being provided with a first one-way valve, wherein the first one-way valve is provided for external fresh air to enter the lower chamber through the intake passage;

an exhaust passage being formed between the exhaust conduit and the lower chamber, and the exhaust passage being provided for dirty air exhaled by the user to pass through and be discharged outside;

a nasal connecting portion, having one end being in fluid communication with the lower chamber, and the other end is provided with a purge valve.

8. The breathable mask according to claim 7, further comprising a second one-way valve, wherein the intake passage is defined by the upper chamber and the first one-way valve, and the exhaust passage is defined by the second one-way valve and an exhaust tunnel; wherein the exhaust tunnel is formed by the waterproof sealing skirt together with a peripheral edge of the lens.

9. The breathable mask according to claim 8, wherein the first one-way valve is disposed on a sidewall at an entrance of the exhaust tunnel, and the second one-way valve is disposed inward further in the exhaust tunnel in view of the first one-way valve, when the user's nose inhales, fresh air enters the lower chamber from the intake conduit, through the upper chamber, the first one-way valve, and then the entrance of the exhaust tunnel, for the user to inhale, whereas when the user's nose exhales, a part of the dirty air passes through the second one-way valve, enters the exhaust conduit to be discharged outside through the exhaust tunnel.

10. The breathable mask according to claim 7, wherein the nasal connecting portion is in fluid communication with the lower chamber through the bottom area.

11. The breathable mask according to claim 10, wherein the bottom area is provided with a third one-way valve, which only allows fluid to pass therethrough from the lower chamber to the nasal connecting portion; thereby when the user exhales through the nose, a part of the dirty air passes through the third one-way valve and is discharged outside through the purge valve of the nasal connecting portion.

12. The breathable mask according to claim 7, wherein the nasal covering portion is made of a material with Shore A hardness of 30-95, and the protruding area extends forward from a rear edge of the main frame to form a cross section having a single-crest mountain shape.

13. The breathable mask according to claim 12, wherein the cross section has a maximum height (Nh) ranging between 20 mm and 35 mm.

14. The breathable mask according to claim 12, wherein the protruding area protrudes forward from the rear edge of the main frame to go beyond a lower, outer edge of the main frame for a maximum extent (Nt) ranging between 5 mm and 20 mm.

15. A breathable mask comprising a body and a breathing tube, the breathing tube being in fluid communication with an interior of the body; the breathing tube including an intake conduit and an exhaust conduit adjacent to the intake conduit, the body including:

a main frame;

a lens fitted in the main frame;

a waterproof sealing skirt, partially fitted with the main frame and the lens, the waterproof sealing skirt being suitable for fitting on a user's face; wherein the waterproof sealing skirt has a partition, which divides the interior of the body into an upper chamber and a lower chamber, whereby when a user wears the breathable mask through a fastening device, the partition is seated on the user's nose, and the user's eyes are accommodated in the upper chamber, whereas the user's nose is accommodated in the lower chamber;

characterized in that the body further includes:

an intake passage being formed between the intake conduit and the lower chamber, and being provided with a first one-way valve, wherein the first one-way valve is provided for external fresh air to enter the lower chamber through the intake passage;

an exhaust passage being formed between the exhaust conduit and the lower chamber, and the exhaust passage being provided for dirty air exhaled by the user to pass through and be discharged outside;

a three-way connector having a nasal connecting portion, a mouth portion, and a drain portion which are in fluid communication with one another, wherein the nasal connecting portion is in fluid communication with the lower chamber, whereby when the user puts on the breathable mask, the mouth portion is suitable for being contained in the user's mouth.

16. The breathable mask according to claim 15, wherein the drain portion is adapted to drain and exhaust downwards and forwards.

17. The breathable mask according to claim 16, wherein the waterproof sealing skirt further includes a nasal covering portion, which defines the lower chamber together with the partition; wherein the nasal covering portion has a protruding area and a bottom area configured to correspond to the user's nostrils.

18. The breathable mask according to claim 17, wherein the nasal connecting portion is in fluid communication with the lower chamber through the bottom area.

19. The breathable mask according to claim 18, wherein the nasal connecting portion and the bottom area is provided with a flexible portion therebetween to promote a movable range of the three-way connector.

20. The breathable mask according to claim 19, wherein the bottom area is provided with a third one-way valve, which only allows fluid to pass therethrough from the lower chamber to the nasal connecting portion; thereby when the user's mouth inhales, the fresh air passes through the third one-way valve and the mouth portion to supply the user; when the user's nose exhales, the dirty air passes through the third one-way valve and the nasal connecting portion, and is discharged outside through a purge valve of the drain portion; when the user's mouth exhales, the dirty air is discharged outward through the purge valve, and water accumulated in the three-way connector is forced out through the purge valve.

21. The breathable mask according to claim 17, wherein the nasal covering portion and the nasal connecting portion are made of a hard material with a Shore D hardness of 50-90, which is selected from polycarbonate (PC), Polypropylene (PP), polyethylene (PE), polyvinylchloride (PVC), acrylonitrile-butadiene-styrene copolymer (ABS) or combinations thereof.

22. The breathable mask according to claim 17, wherein the nasal covering portion is made of a softer material with Shore A hardness of 30-95, and the protruding area extends forward from a rear edge of the main frame to form a cross section having a single-crest mountain shape.

23. The breathable mask according to claim 22, wherein the cross section has a maximum height (Nh) ranging between 20 mm and 35 mm.

24. The breathable mask according to claim 22, wherein the protruding area protrudes forward from the rear edge of the main frame to go beyond a lower, outer edge of the main frame for a maximum extent (Nt) ranging between 5 mm and 20 mm.

25. The breathable mask according to claim 16, further comprising a second one-way valve, wherein the intake passage is defined by the upper chamber and the first one-way valve, and the exhaust passage is defined by the second one-way valve and an exhaust tunnel; wherein the exhaust tunnel is formed by the waterproof sealing skirt together with a peripheral edge of the lens.

26. The breathable mask according to claim 16, wherein the drain portion includes a base extending downward from the nasal connecting portion, the base has a first connecting portion and a second connecting portion opposing to the first connecting portion, the first connecting portion is suitable for accommodating a purge valve fixed therein, and the mouth portion is jointly defined by the second connecting portion and a mouthpiece fixed thereto.

27. The breathable mask according to claim 26, wherein the drain portion further includes a baffle, wherein the baffle, the purge valve and the first connecting portion jointly define the drain portion, the baffle extends downwards from the nasal connecting portion and faces the purge valve, and the baffle and the purge valve are snap-fitted to form a gap therebetween; when the user exhales, the dirty air or accumulated water is discharged laterally through the gap.

28. The breathable mask according to claim 15, further comprising a second one-way valve, wherein the intake passage is defined by the upper chamber and the first one-way valve, and the exhaust passage is defined by the second one-way valve and an exhaust tunnel; wherein the exhaust tunnel is formed by the waterproof sealing skirt together with a peripheral edge of the lens.

29. The breathable mask according to claim 28, wherein the first one-way valve is disposed on the partition, and the second one-way valve is disposed at an entrance of the exhaust tunnel; when the user's nose inhales, the fresh air passes from the intake conduit, through the upper chamber and the first one-way valve, to the lower chamber, to supply the user's nose to inhale; when the user's nose exhales, part of the dirty air passes through the second one-way valve, enters the exhaust conduit through the exhaust tunnel, and is discharged outside.

30. The breathable mask according to claim 15, wherein the drain portion drains and exhausts downwards and sidewards.

* * * * *